US008056885B2

(12) United States Patent
Sandor, Sr.

(10) Patent No.: US 8,056,885 B2
(45) Date of Patent: Nov. 15, 2011

(54) STAIR, RAMP, OR BALCONY RAILING SYSTEM

(76) Inventor: Frederick J. Sandor, Sr., Satellite Beach, FL (US)

( * ) Notice: Subject to any disclaimer, the term of this patent is extended or adjusted under 35 U.S.C. 154(b) by 0 days.

(21) Appl. No.: 13/029,861

(22) Filed: Feb. 17, 2011

(65) Prior Publication Data

US 2011/0140063 A1 Jun. 16, 2011

Related U.S. Application Data

(62) Division of application No. 11/598,266, filed on Nov. 13, 2006, now Pat. No. 7,913,983.

(51) Int. Cl.
*E04H 17/14* (2006.01)

(52) U.S. Cl. ..... 256/67; 256/59; 256/60

(58) Field of Classification Search ..... 256/19, 256/59, 60, 67, 65.02, 65.11, 65.14, 65.03
See application file for complete search history.

(56) References Cited

U.S. PATENT DOCUMENTS

| | | | | |
|---|---|---|---|---|
| 191,944 | A | 6/1877 | Dewey | |
| 210,526 | A | 12/1878 | Hanson | |
| 250,046 | A | 11/1881 | Rogers | |
| 263,324 | A | 8/1882 | Devoe | |
| 351,194 | A | 10/1886 | McDougall | |
| 372,254 | A | 10/1887 | Cooper | |
| 1,084,850 | A | 1/1914 | Ford | |
| 1,234,674 | A | 7/1917 | Lachman | |
| 1,297,838 | A | 3/1919 | Haines | |
| 1,772,159 | A | 8/1930 | Roth | |
| 1,776,517 | A | 9/1930 | MacDonald | |
| 2,669,434 | A | 2/1954 | White | |
| 3,352,541 | A | 11/1967 | Thom | |
| 3,604,686 | A | 9/1971 | Parisien | |
| 3,604,687 | A * | 9/1971 | Moore | 256/65.03 |
| 3,804,374 | A * | 4/1974 | Thom | 256/59 |
| 4,037,788 | A * | 7/1977 | Riley | 256/65.02 |
| 4,193,229 | A | 3/1980 | Hartman | |
| 4,408,749 | A | 10/1983 | Zeig | |
| 5,496,016 | A * | 3/1996 | Parisien | 256/68 |
| 6,145,814 | A | 11/2000 | Perrot | |
| 6,299,143 | B1 | 10/2001 | Valentine | |

* cited by examiner

*Primary Examiner* — Michael P Ferguson
(74) *Attorney, Agent, or Firm* — The Smiley IP Law Group, P.A.; Scott D. Smiley

(57) ABSTRACT

A railing system includes a set of vertically disposed baluster assemblies and a plurality of railing members. The baluster assemblies include a lower base member receiving a pair of opposing vertical plates. Each of the pairs of plates have opposing aligned pairs of throughbores, each pair movably holding therein one of a set of insert members. Railing members each slide through adjacent pairs of insert members to form a wall of spaced apart railing members. Each railing member passes through the insert members in each of the baluster assemblies and the insert members holding the railing member pivot to align member throughbores at an angle from horizontal that is dependent upon a vertical difference of adjacent ones of the fixed base members.

10 Claims, 29 Drawing Sheets

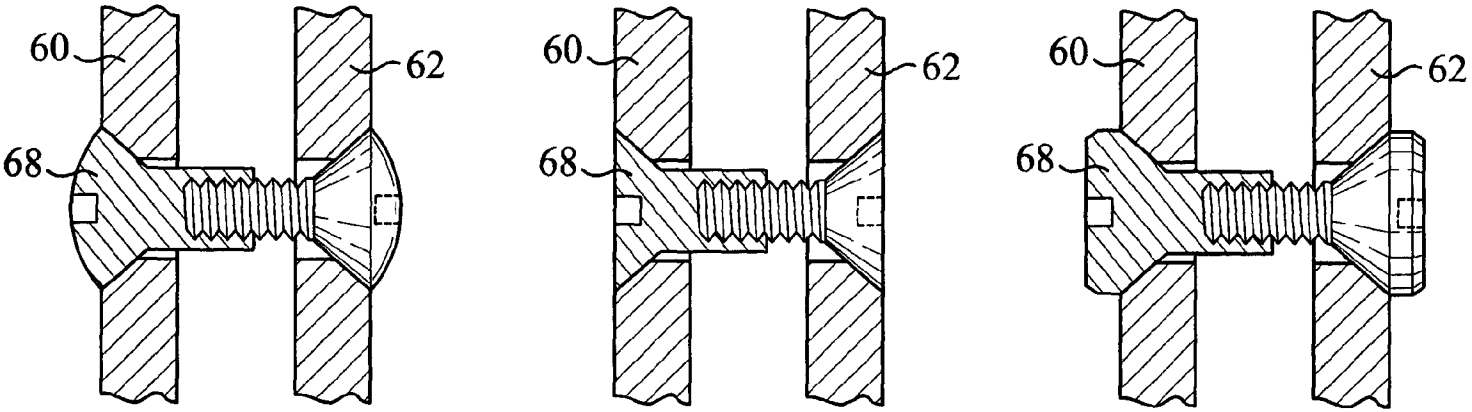
FIG. 16A
FIG. 16B
FIG. 16C
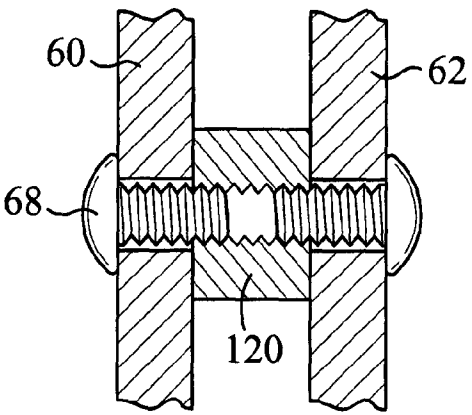
FIG. 16D
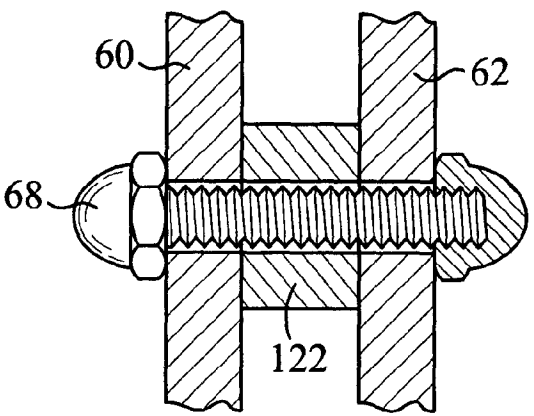
FIG. 16E

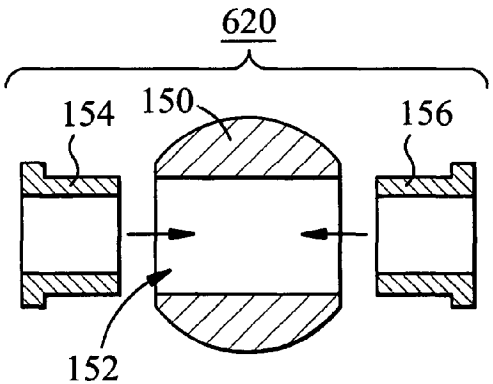
FIG. 18B
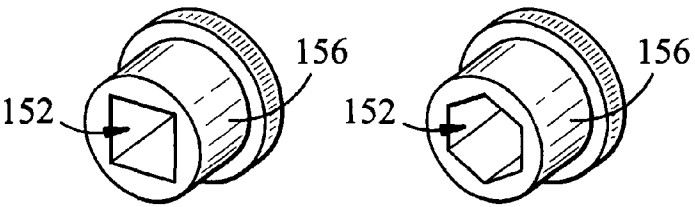
FIG. 18E
FIG. 18D
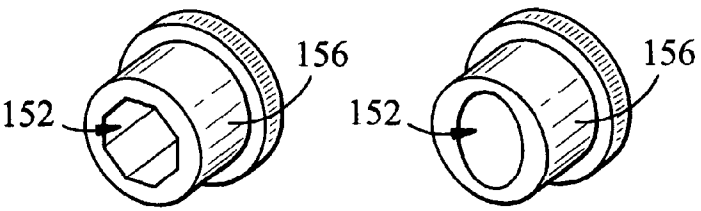
FIG. 18G
FIG. 18F
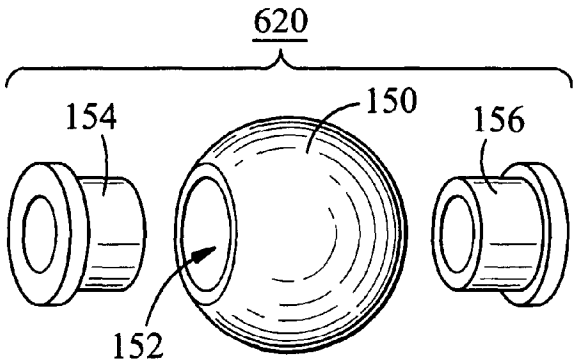
FIG. 18A
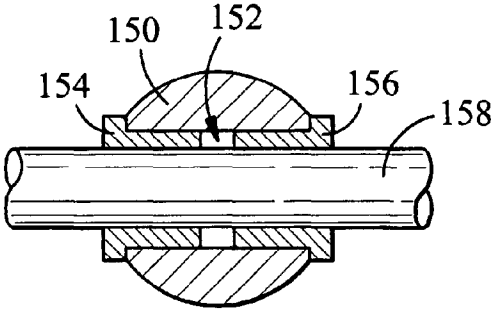
FIG. 18C

STAIR, RAMP, OR BALCONY RAILING SYSTEM

CROSS-REFERENCE TO RELATED APPLICATIONS

This application is:

a divisional of U.S. patent application Ser. No. 11/598,266, filed on Nov. 13, 2006 now U.S. Pat No. 7,913,983; the entire disclosure of which is hereby incorporated herein by reference in its entirety.

STATEMENT REGARDING FEDERALLY SPONSORED RESEARCH OR DEVELOPMENT

Not Applicable

FIELD OF THE INVENTION

The present invention relates to railings generally and, more particularly, but not by way of limitation, to a novel stair, ramp, or balcony railing system.

BACKGROUND OF THE INVENTION

Most current systems require posts or balusters to be accurately drilled at the proper angle and frequency required to achieve the desired spacing and slope. This is very difficult and expensive—requiring expertise and experience and expensive equipment.

Some attempts at providing a simplified railing system are as follows:

U.S. Pat. No. 210,526, issued Dec. 3, 1878, to Hanson, and titled IRON-FENCE, discloses an iron fence consisting of two channel shaped railings with the tongues of cylindrical picket holding members inserted in the channels. Pickets are held externally in the cylindrical picket holding members.

U.S. Pat. No. 1,772,159, issued Aug. 5, 1930, to Roth, and titled RAIL CONNECTION, discloses in FIGS. 5 and 6 spheres mounted in the ends of balusters and attached to rails at any angle by means of screws passing through the rails and the spheres. U.S. Pat. No. 4,408,749, issued Oct. 11, 1983, to Zieg, and titled VARIABLE PITCH RAILING AND SYSTEM, discloses a railing system in which the ends of balusters are fitted with segments of spheres. The segments of spheres fit into complementary shaped arcuate openings formed in the rails and the ends of the balusters are confined by elongated molding. Thus, the balusters can be rotated to almost any degree.

U.S. Pat. No. 6,145,814, issued Nov. 14,2000, to Perrot, and titled DEVICE FOR MOUNTING HANDRAIL ELEMENT ON A POST IN PARTICULAR FOR PRODUCING A STAIRCASE AND A SET PROVIDED THEREFOR, discloses in pertinent aspects a railing system similar to that of the '749 patent above.

U.S. Pat. No. 6,299,143, issued Oct. 9, 2001, to Valentine, and titled COUPLING SPOOL, discloses a railing system in which a spool is slid internally of a rail until it is aligned with an opening formed in the rail. A picket is inserted into the spool and is attached to the spool by welding, bonding, or other attachment methods to secure the picket in the rail. The picket can then be rotated within the rail as guided by the spool.

All of the above are relatively complicated and/or expensive.

Accordingly, it is a principal object of the present invention to provide a railing system for stairs, ramps, or balconies that offers adjustable angle capability and ease of installation for, for example, wire, cable, pipe, rod, or the like.

It is a further object of the present invention to provide such a system that captures members of metal, plastic, glass, tubes (round, oval, or multi-sided), or composite, or the like at pre-determined spacing with holes formed in the members. The holes are of proper diameter to permit the members to pass therethrough with the members rotated as required to the desired slope.

It is an additional object of the invention to provide holes that are oversized with the desired hole diameter achieved with varying bushings.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing an apparatus, comprising: a plurality of members disposed inside generally vertical balusters; each said member having formed therethrough a hole; a plurality of wires, cables, rods, pipes, tubes (round, oval, or multi-sided), or the like, each one disposed through one of said holes; and said members being rotatable to position said wires, cables, rods, pipes, tubes (round, oval, or multisided), or the like at a selected angle from horizontal.

BRIEF DESCRIPTION OF THE DRAWINGS

The accompanying drawings, which are incorporated by reference and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIGS. 16A-16E are fragmentary side elevational views showing various methods of clamping together baluster halves.

FIGS. 18A-18G show a ball with an oversized hole formed through the center thereof, the excess being taken up by bushings.

DETAILED DESCRIPTION OF THE PREFERRED EMBODIMENTS

Figure 1:
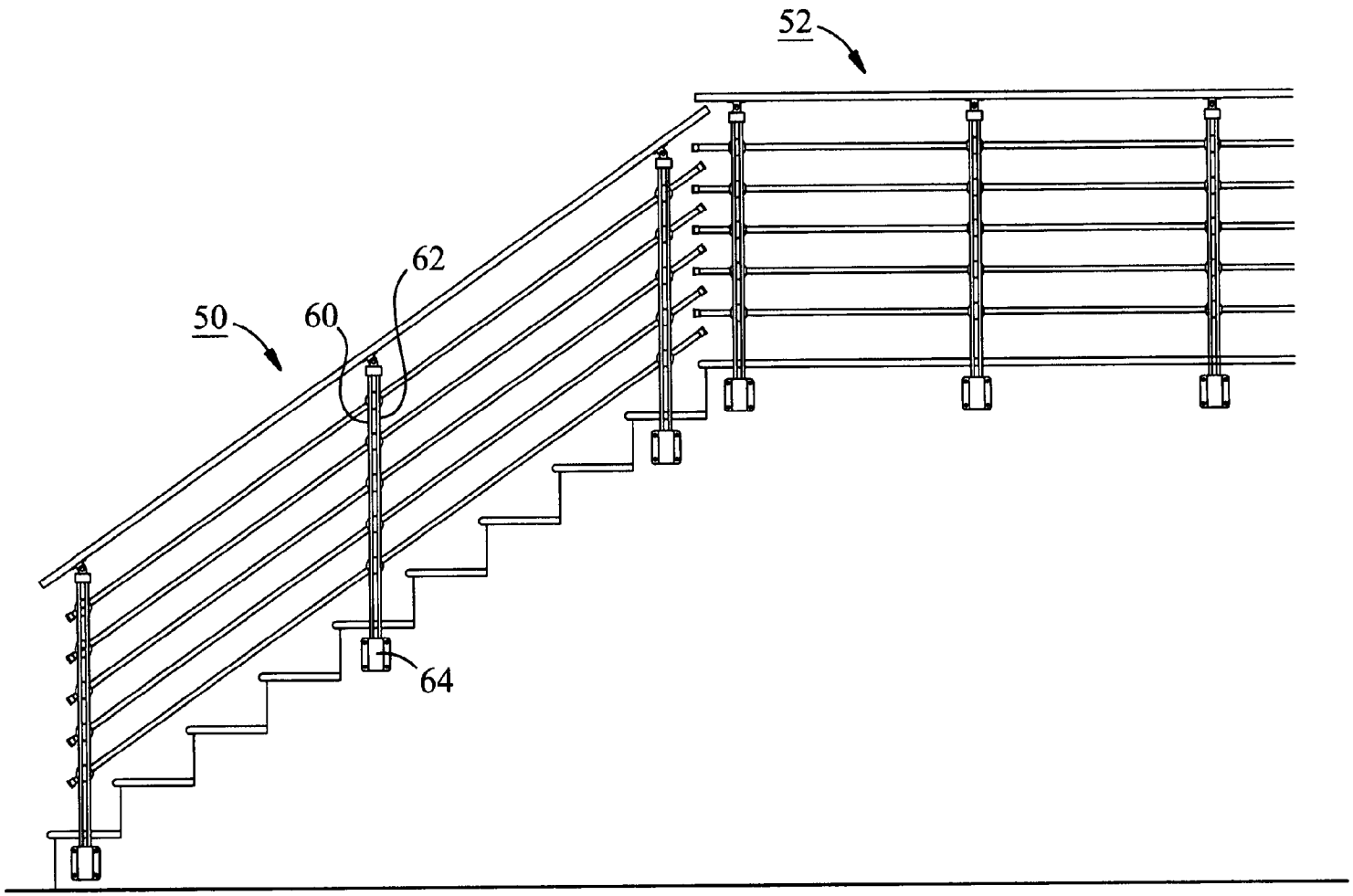
FIG. 1 is a side elevational view of a stair and balcony railing system, constructed according to the present invention, and showing a side mount version.

Reference should now be made to the drawing figures, provided for purposes of illustration only, and on which the figure numerals in parentheses (when used) refer the reader to the figure in which the element(s) being described are more fully shown, although the element(s) may be shown on other figures also.

FIG. 1 illustrates a stair railing and a balcony railing, constructed according to the present invention, and generally indicated, respectively by the reference numerals 50 and 52. Stair and balcony railings 50 and 52 are of the side mount type, that is, the halves, as at 60 and 62, of the generally vertical balusters thereof are inserted in brackets, as at 64, mounted on the generally vertical sides of the stairs and the balcony.

Figure 2:
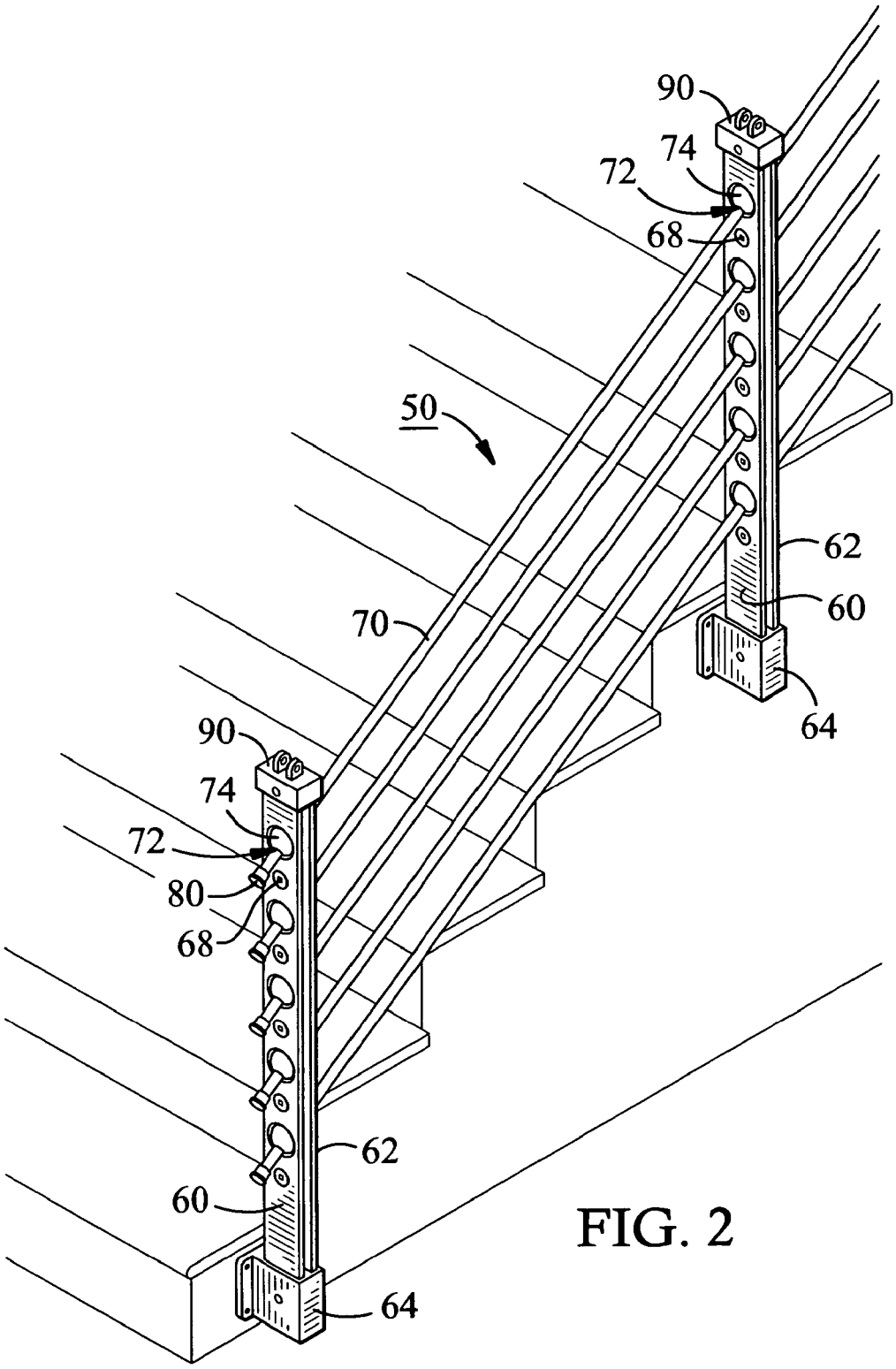
FIG. 2 is a fragmentary, isometric view of the stair portion of FIG. 1, without the handrail.

FIG. 2 illustrates the details of construction of railings 50, here, two halves 60 and 62 of balusters of stair railing 50. Wires, cables, rods, pipes, tubes, or the like, for example, as at 70, are inserted through centrally positioned holes, as at 72, formed in members, as at 74, and the members rotated to their desired positions. Baluster halves 60 and 62 can also be halves of square or rectangular stock. Baluster halves 60 and 62 are then squeezed together by clamping means, as at 68, preventing members 74 from rotating further, thus fixing the members in their desired positions. Members 74 can be steel, stainless steel, aluminum, carbon fiber, or any suitable material. Baluster halves 60 and 62 can be steel, stainless steel, aluminum, glass, plastic, carbon fiber, or any suitable material. Holes 72 may be drilled, punched, stamped, etc. Caps or plugs, as at 80, may be provided on the ends of the wires, cables, rods, pipes, tubes, or the like 70. Brackets 90 are provided at the upper ends of baluster halves 60 and 62 for attached thereto of handrails (not shown on FIG. 2) as described infra.

Figure 3:
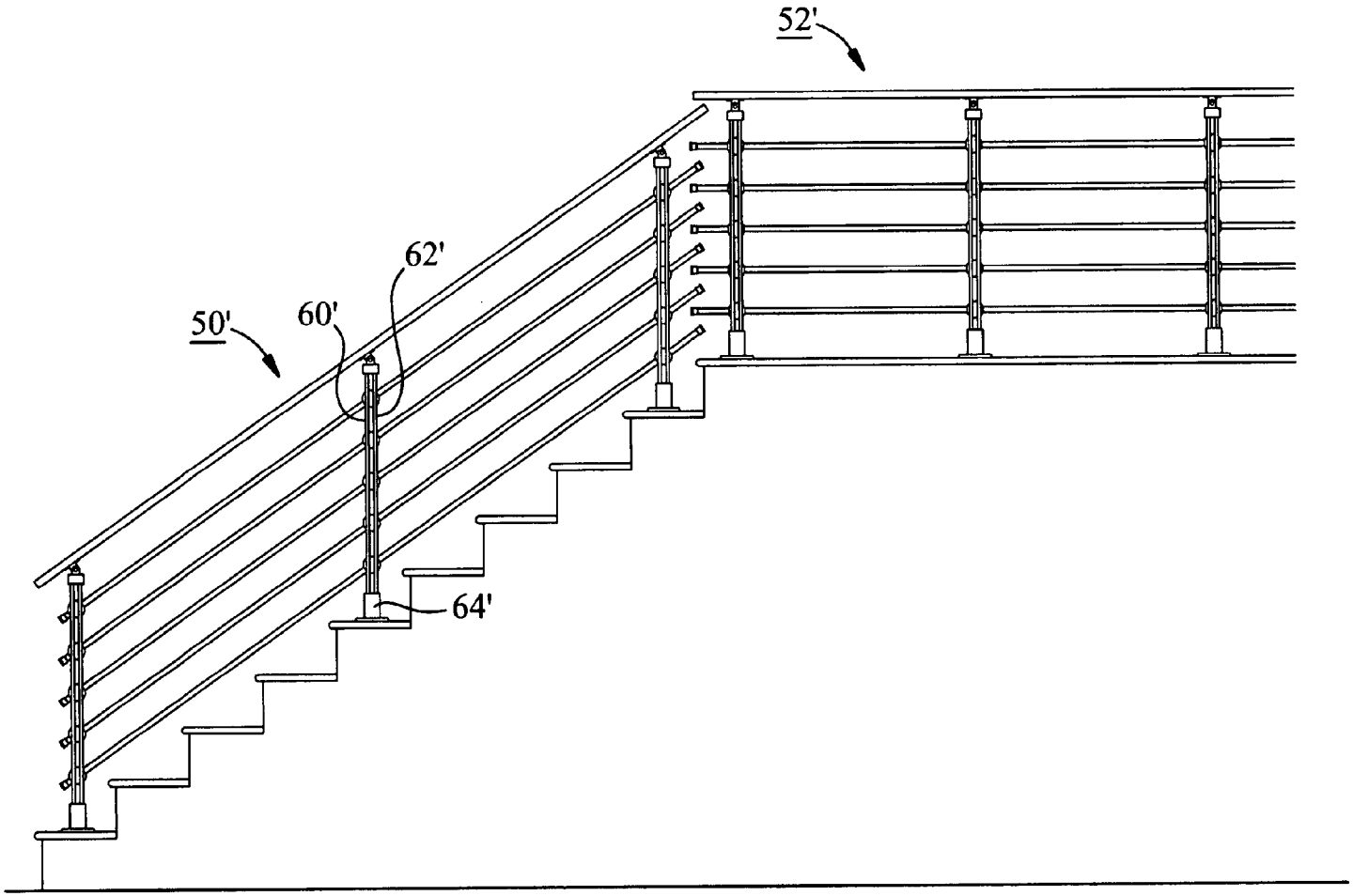
FIG. 3 is a side elevational view of a stair and balcony railing system, constructed accord to the present invention, and showing a surface mount version.

FIG. 3 illustrates a stair railing and a balcony railing, constructed according to the present invention, and generally indicated, respectively, by the reference numerals 50' and 52'. Elements of railings 50' and 52' having generally the same function as the elements of railings 50 and 52 (FIG. 1) are given primed reference numerals. The only difference between railings 50 and 52 and railings 50' and 52' is that the baluster halves of railings 50' and 52' are of the surface mount type, that is, the halves, as at 60 and 62, of the generally vertical balusters thereof are inserted in brackets, as at 64, mounted on the generally horizontal surfaces of the stairs and the balcony.

Figure 4:
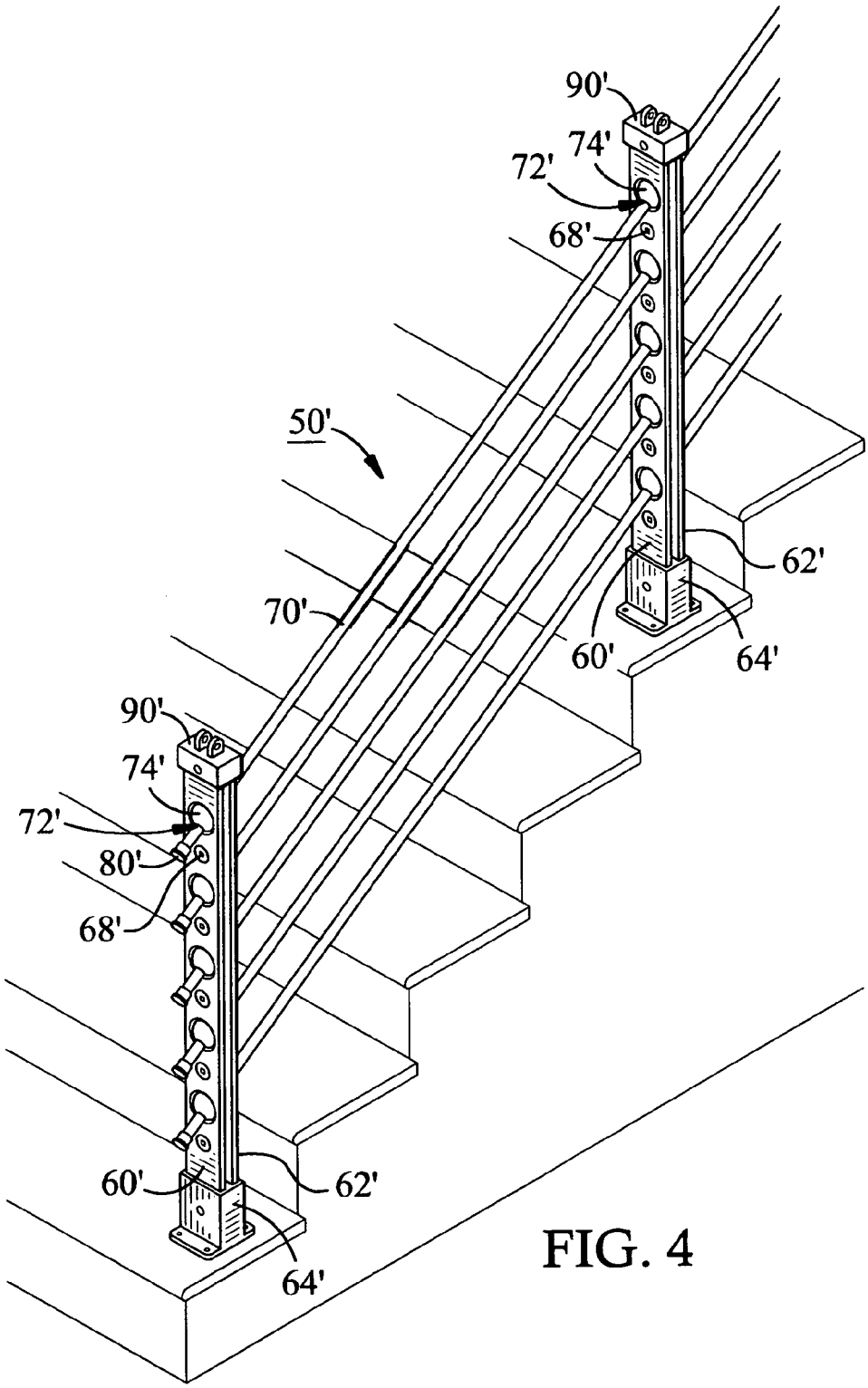
FIG. 4 is a fragmentary, isometric view of the stair portion of FIG. 3, without the handrail.

FIG. 4 illustrates the details of construction of railings 50' and 52', here, two balusters halves of railing 50' are inserted in surface mount 64'.

Figure 5:
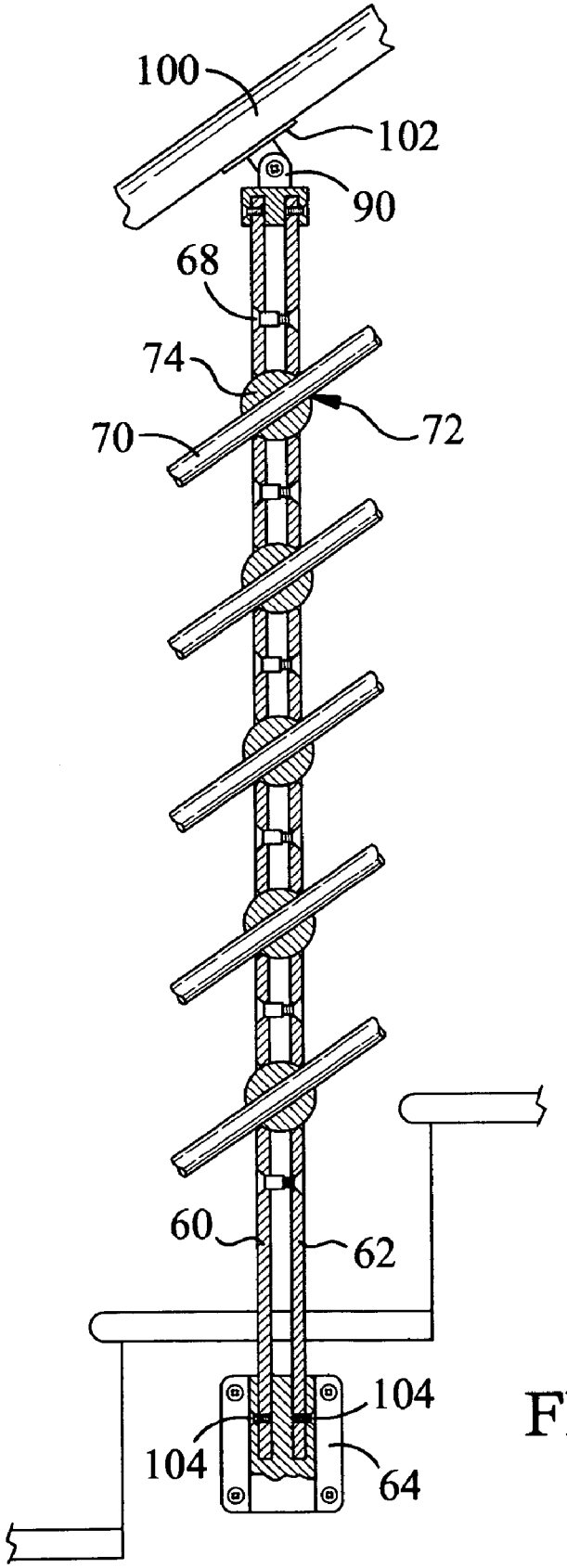
FIG. 5 is a side elevational view, partially in cross-section, of one stair baluster in side mount configuration.

FIG. 5 illustrates details of the construction of baluster halves 60 and 62 (FIG. 2) and shows that handrail 100 has been attached to bracket 90 by means of bracket 102 rotatably engaging bracket 100 and that the lower ends of the baluster halves are securely fastened to bracket 64 by means of two screws 104.

Figure 6:
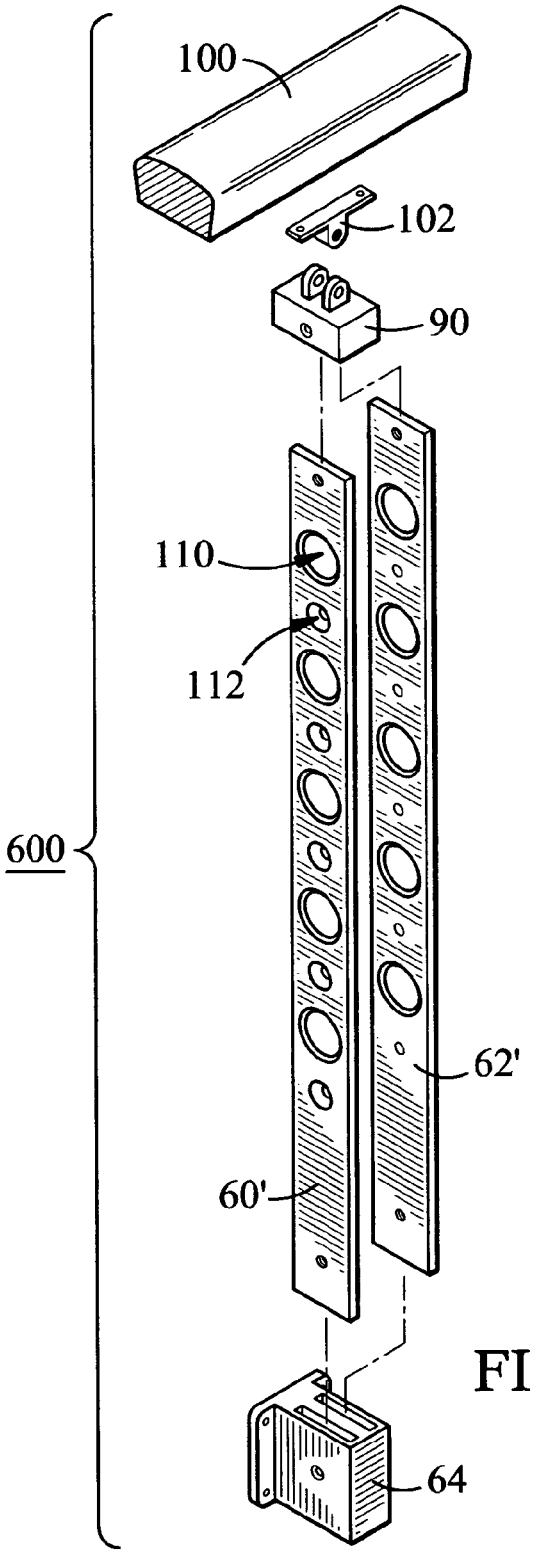
FIG. 6 is a fragmentary, exploded, isometric view of the baluster of FIG. 5.

FIG. 6 illustrates details of construction of baluster 600, with baluster halves 60 and 62 (FIG. 2) and shows holes, as at 110, for the partial protrusion of members 74 (FIG. 5) and holes, as at 112, for the insertion therein of clamping means 68.

Figure 7:
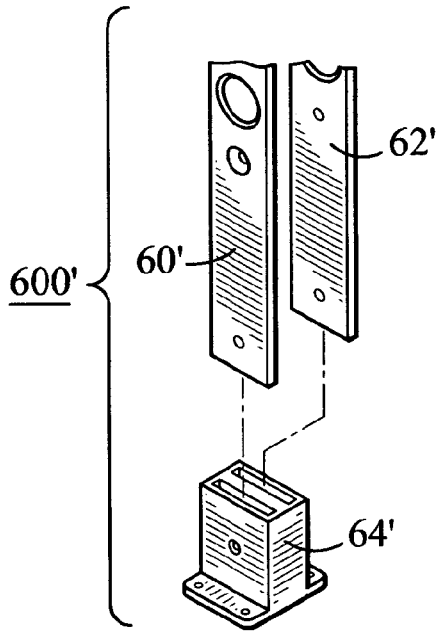
FIG. 7 is an isometric view, of the baluster of FIG. 6 in surface mount configuration.

FIG. 7 illustrates baluster halves 60' and 62' to be inserted in bracket 64'.

Figure 8A:
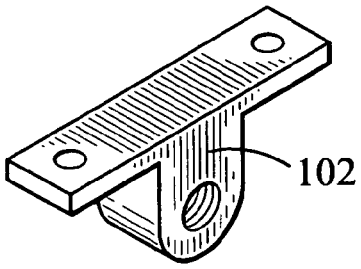
FIGS. 8A-9B are isometric views of a method of attachment of the handrail.
Figure 8B:
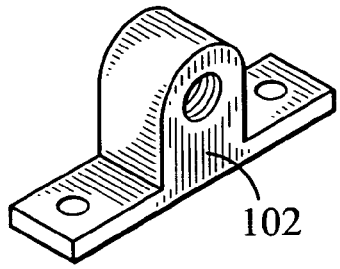
Figure 9A:
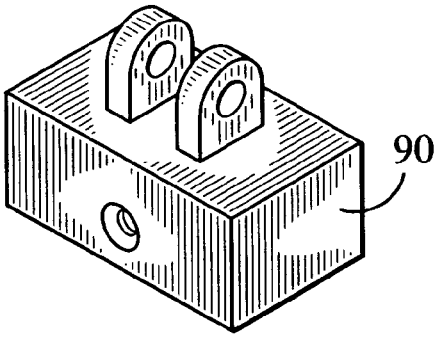
Figure 9B:
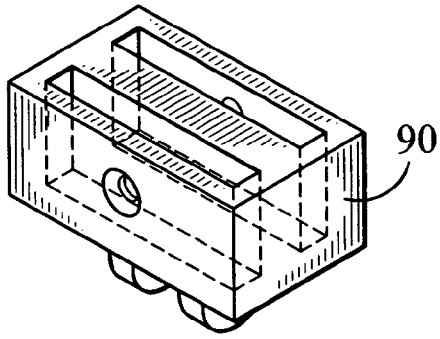
Figure 10:
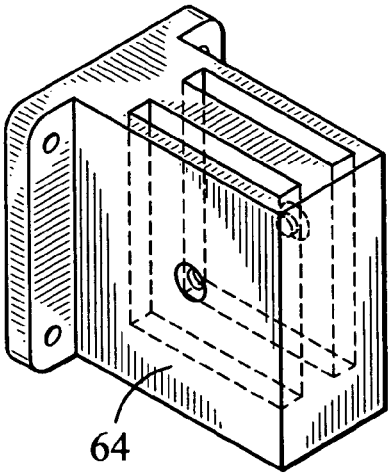
FIG. 10 is an isometric view of a side mount bracket.
Figure 11:
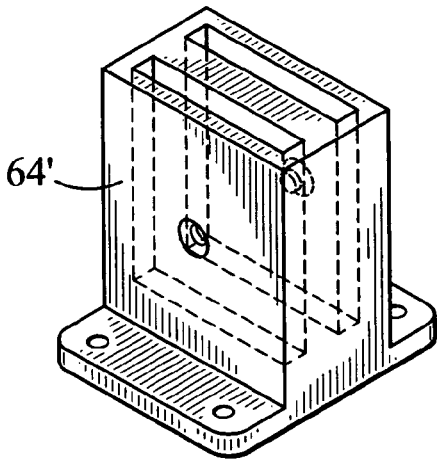
FIG. 11 is an isometric view of a surface mount bracket.

FIGS. 8A, 9A, 10, and 11 show brackets 102, 90, 64, and 64', respectively, in their upright positions, while FIGS. 8B and 9B show brackets 102 and 90, respectively, in their inverted positions.

Figure 12:
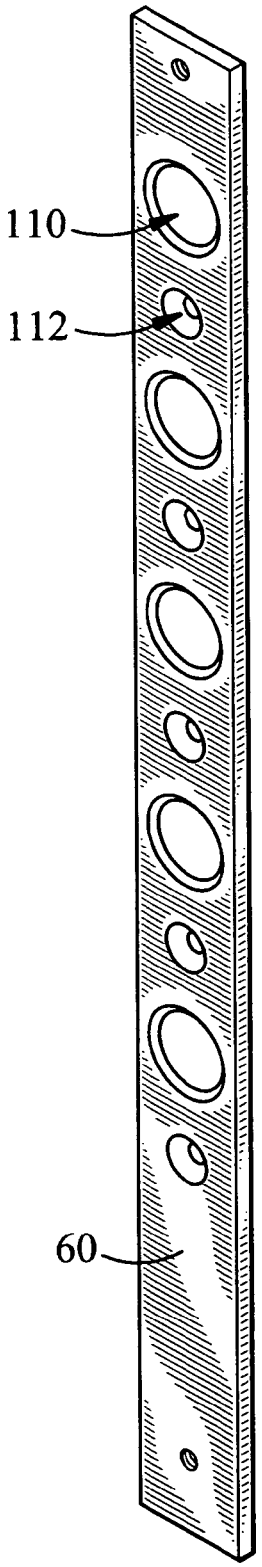
FIG. 12 is an isometric view of a baluster half.
Figure 13:
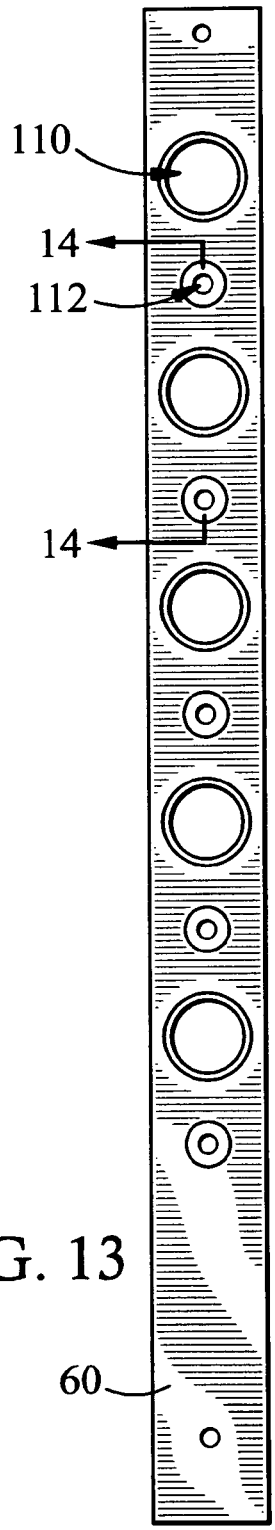
FIG. 13 is an end elevational view of a baluster half.

FIG. 12 illustrates an isometric view of baluster half 60, while FIG. 13 illustrates an end elevational view of the baluster half (both FIG. 5).

Figure 15:
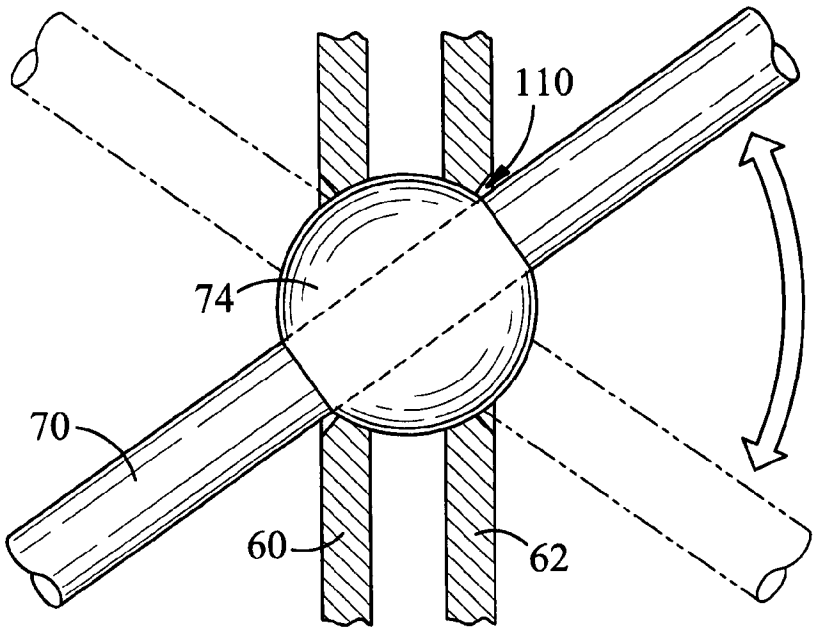
FIGS. 14 and 15 show the range of rotational motion achievable with the present invention, with FIG. 14 being taken along line "14-14" of FIG. 13.
Figure 14:
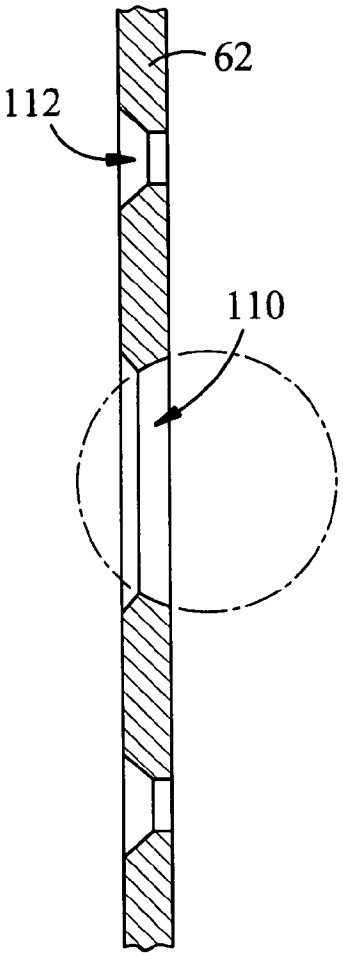

FIGS. 14 and 15 illustrate the range of rotation of member 74, which range of rotation is at least forty-five degrees in either direction from horizontal.

FIGS. 16A-16E illustrate various configurations clamping means 68 can take (FIG. 5). On FIGS. 16A-C no spacer is provided between baluster halves 60 and 62. On FIGS. 16D-16E, spacers 120 and 122, respectively, are provided between baluster halves 60 and 62. Clamping means can also be accomplished by welding, gluing, or other methods.

Figure 17A:
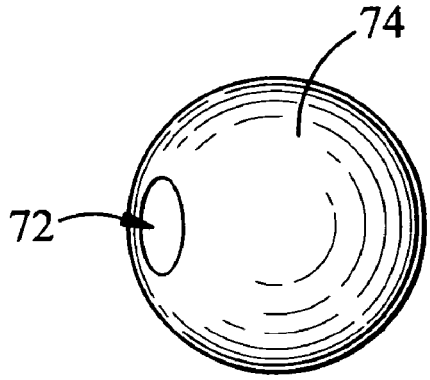
FIGS. 17A-17C show a ball with a hole formed through the center thereof.
Figure 17B:
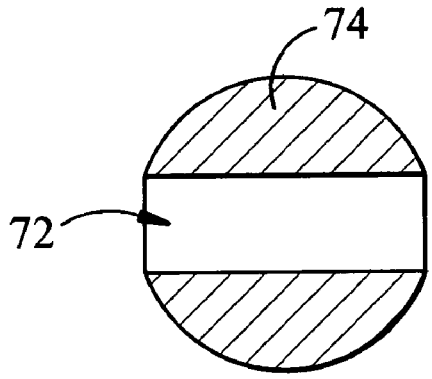
Figure 17C:
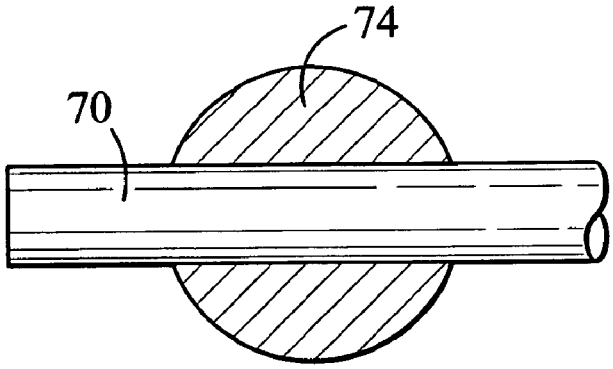

FIGS. 17A and 17B illustrate member 74 with a hole 72 formed therein (FIG. 5). FIG. 17C illustrates a wire, cable, rod, pipe, or the like inserted in hole 72 (FIGS. 17A and 17B).

FIG. 18A-18G illustrate a spherical member 150 having a hole 152 formed therethrough and bushings 154 and 156 inserted in the ends of the hole, with a wire, cable, rod, tubing (round, oval, or multi-sided), or pipe 70 (FIGS. 18G) inserted in the hole. This arrangement is used when the diameter of hole 152 is larger than the diameter of wire, cable, rod, pipe, tubing (round, oval, or multi-sided), or the like 70.

Figure 19:
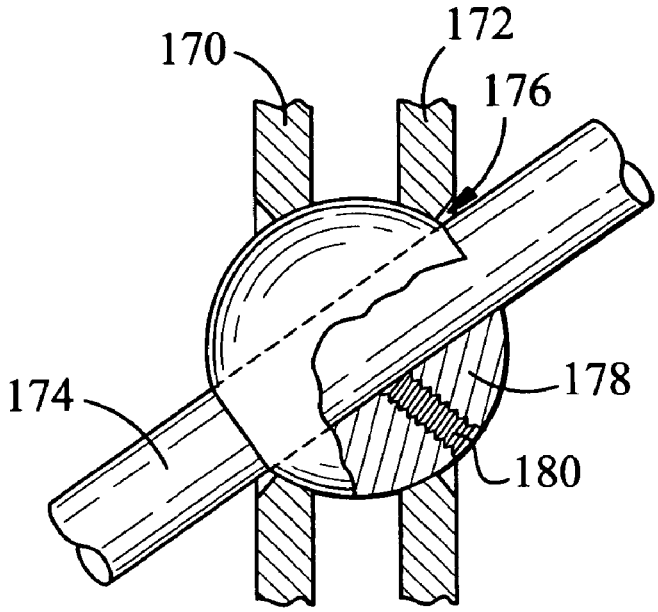
FIGS. 19 and 20 are fragmentary, side elevational view showing alternative methods of fixing a ball in place, the ball rotating between the halves of the balusters.

FIG. 19 illustrates baluster halves 170 and 172, with a wire, cable, rod, or pipe 174 inserted in a hole 176 formed in a spherical member 178. A set screw (not shown on FIG. 19) is advanced through spherical member 178 against wire, cable, rod, pipe, or the like 174 to secure the wire, cable, rod, pipe, or the like in place.

Figure 20:
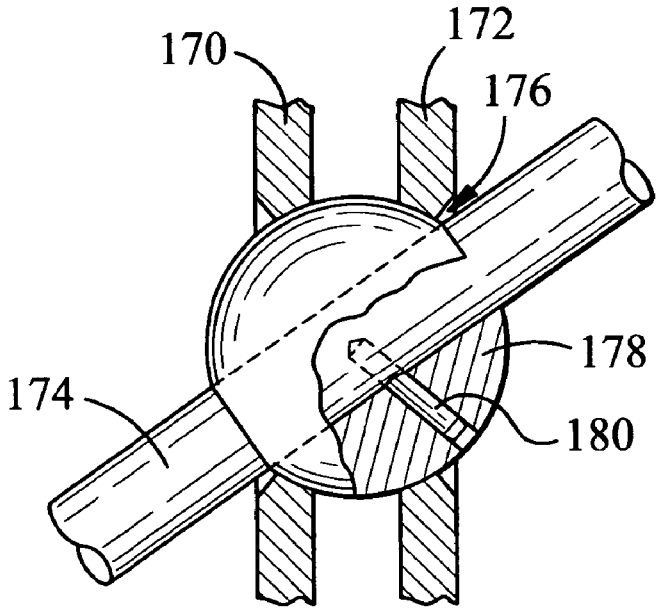

FIG. 20 illustrates baluster halves 170 and 172 as shown on FIG. 19, except that the set screw has been replaced with a pin 190, the function of pin 190 being the same as the set screw.

Figure 21:
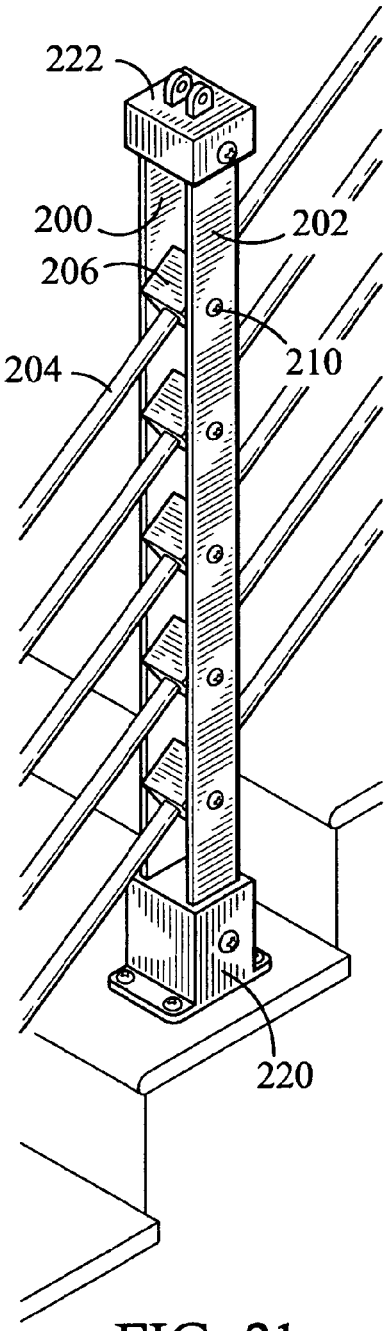
FIGS. 21 and 22 are fragmentary, isometric views showing alternative methods of fixing the members in place between two baluster halves, the baluster halves being of the surface mount configuration on a stair railing, the members comprising cylinders and squares.

FIG. 21 illustrates baluster halves 200 and 202 with a wire, cable, rod, or pipe 204 inserted through a hole formed in a square member 206. It will be noticed that baluster halves 200 and 202 are rotated ninety degrees from baluster halves 60' and 62' shown on FIG. 4 and that the baluster halves 200 and 202 are not squeezed together, but members 206 are free to rotate around a screw, as at 210. Generally vertical baluster halves 200 and 202 are fixed at their lower ends in a surface mount bracket 220 and have a bracket 222 for the attachment of a handrail (not shown on FIG. 21).

Figure 22:
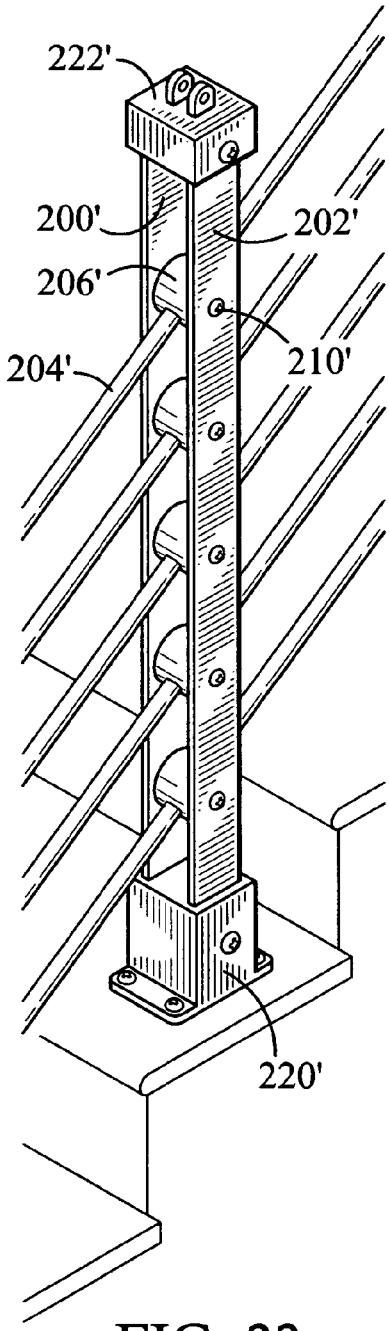

FIG. 22 illustrates baluster halves 200' and 202'. Elements of baluster halves 200' and 202' having generally the same function as the elements of baluster halves 200 and 202 (FIG. 21) are given primed reference numerals. The only difference between baluster halves 200 and 202 and railings 200' and 202' is that the baluster halves have therebetween cylindrical members 206' rather than square members 206.

Figure 23:
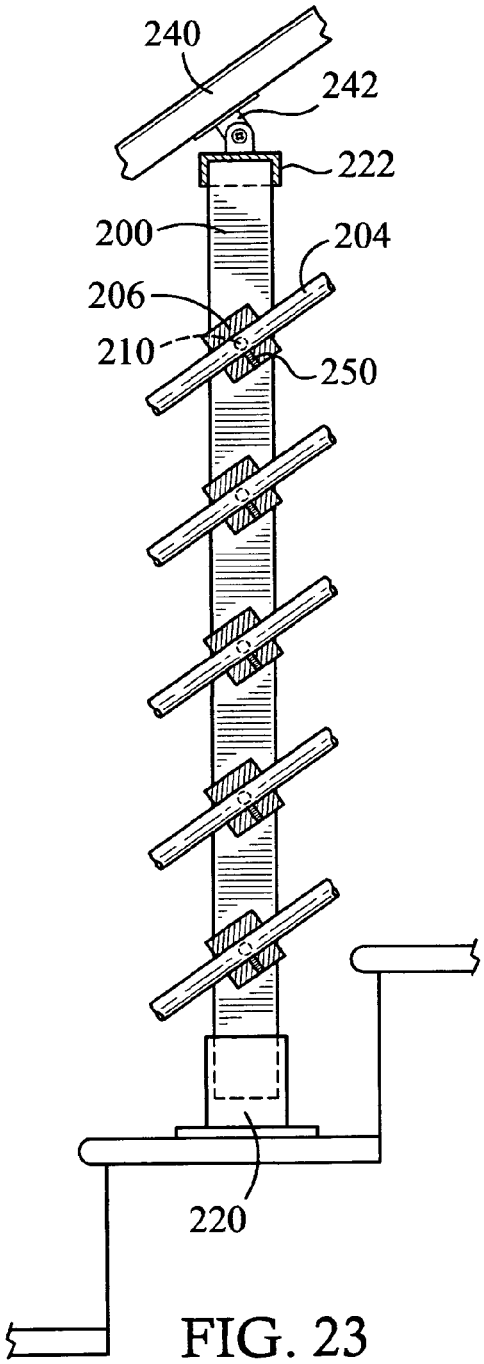
FIGS. 23 and 24 are fragmentary, side elevational view, partially in cross-section of the methods of FIGS. 19-22.

FIG. 23 is a side elevational view of FIG. 21 and further shows that handrail 240 has been attached by means of bracket 242 and that wire, cable, rod, pipe, or the like 204 is held securely in place by means of set screw 250.

Figure 24:
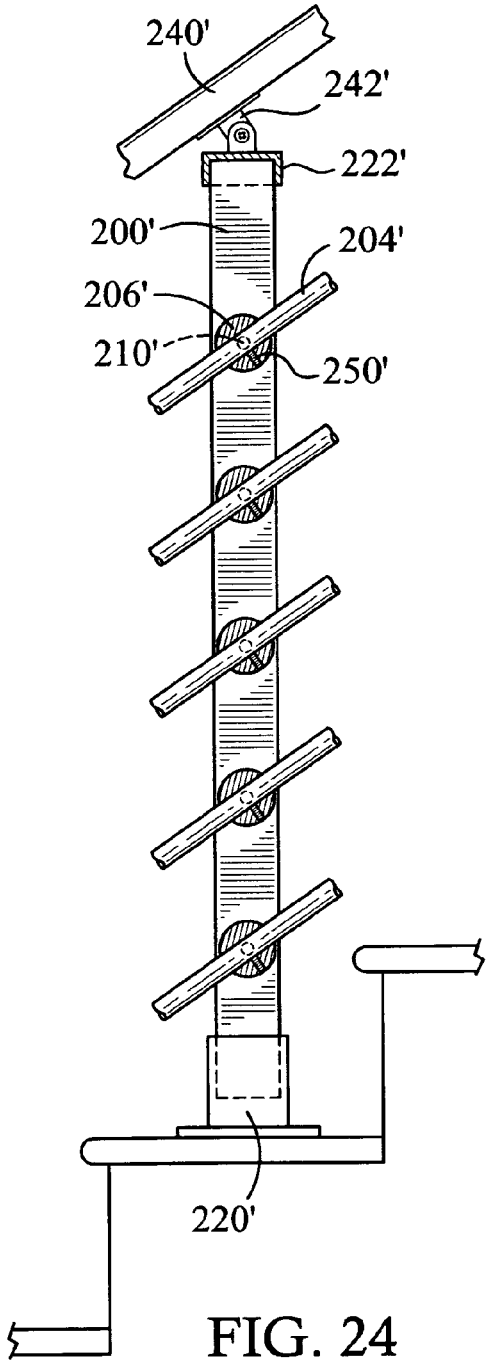

FIG. 24 is a side elevational view of FIG. 22. Elements of having generally the same function as the elements described with reference to FIG. 22 are given primed reference numerals.

Figure 26:
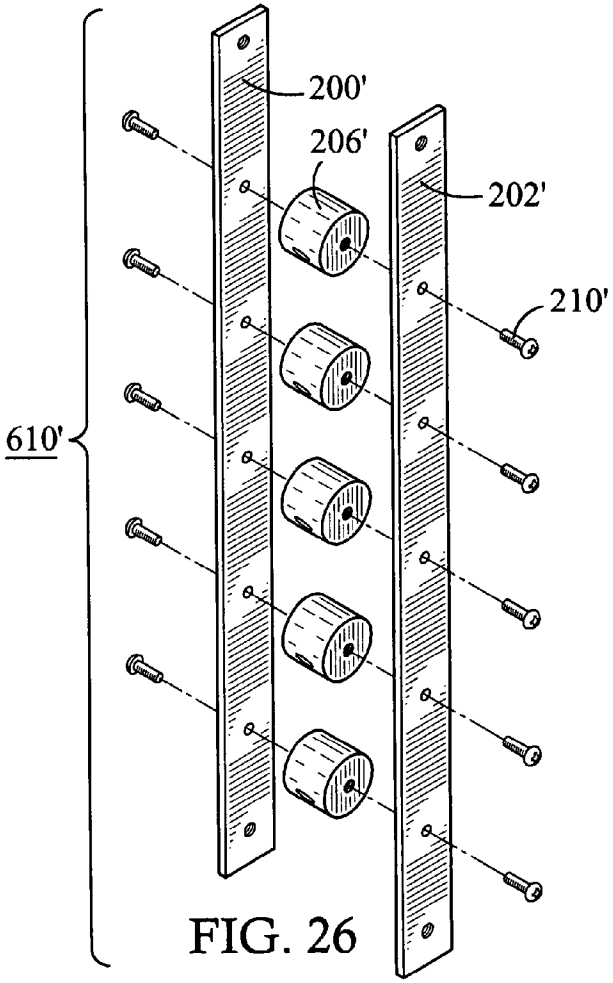
FIGS. 25 and 26 are fragmentary, exploded, isometric views of the alternative embodiments of FIGS. 23 and 24.
Figure 25:
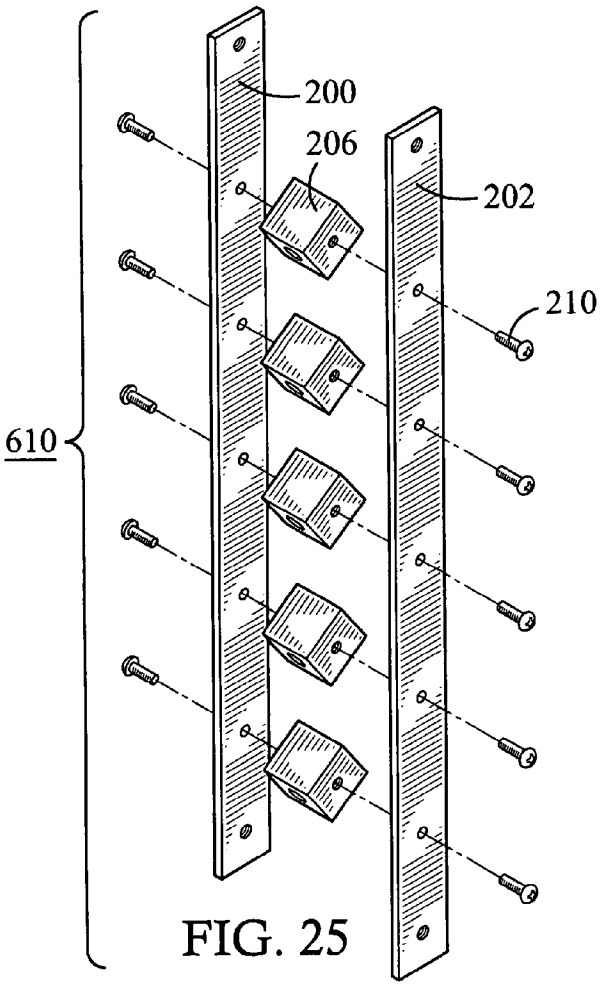

FIGS. 25 and 26 are fragmentary isometric views, respectively, of FIGS. 23 and 24, showing balusters 610 and 610', respectively.

Figure 27A:
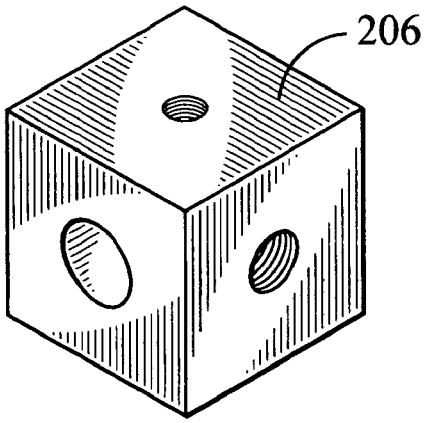
FIGS. 27 and 28 show details of the alternative embodiments of FIGS. 25 and 26.
Figure 27B:
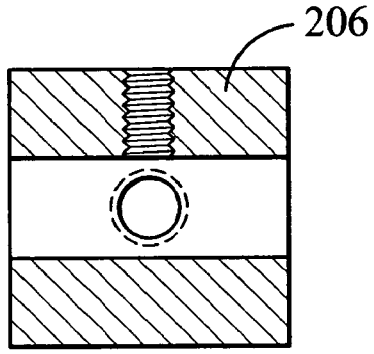

FIGS. 27 A and 27B illustrate square member 206 (FIG. 23).

Figure 28A:
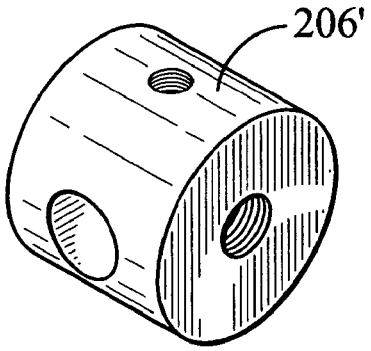
Figure 28B:
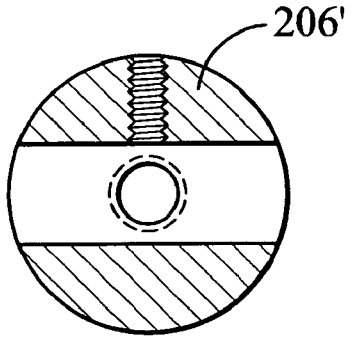

FIGS. 28A and 28B illustrate cylindrical member 206' (FIG. 24).

Figure 29:
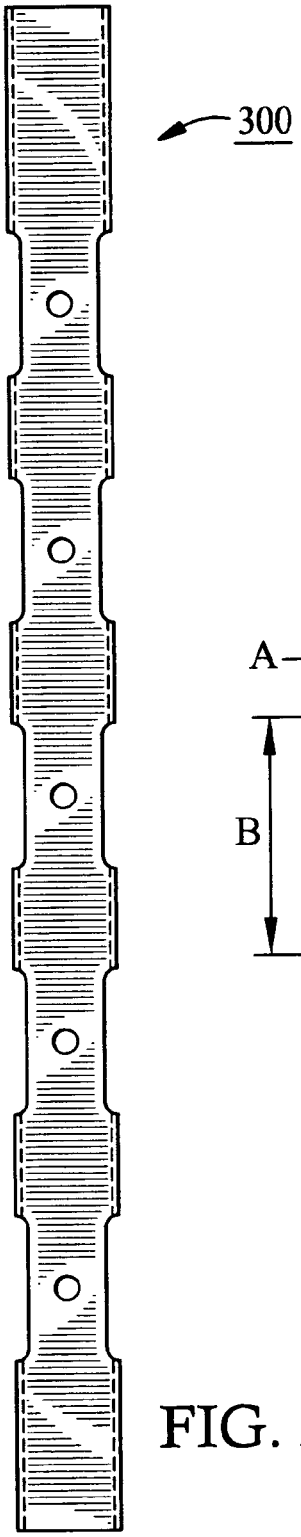
FIG. 29 is a side elevational view of a square baluster.

FIG. 29 illustrates a milled square baluster, generally indicated by the reference numeral 300.

Figure 30:
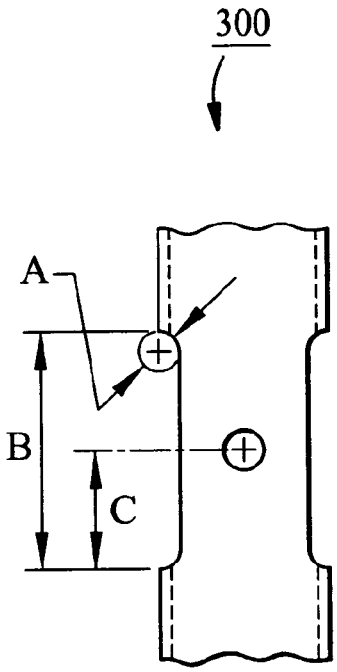
FIG. 30 is a side elevational view showing the milling of the square baluster of FIG. 29.

FIG. 30 illustrates a fragmentary view of a milled, square baluster 300. "A" represents the diameter of the milling cutter (which can vary depending on the diameter of the rails-not shown). "B" is the length of the milled area to accommodate the extreme angle of the rails. "C" shows that the milled area is centered to mount the rail rod nut.

Figure 31:
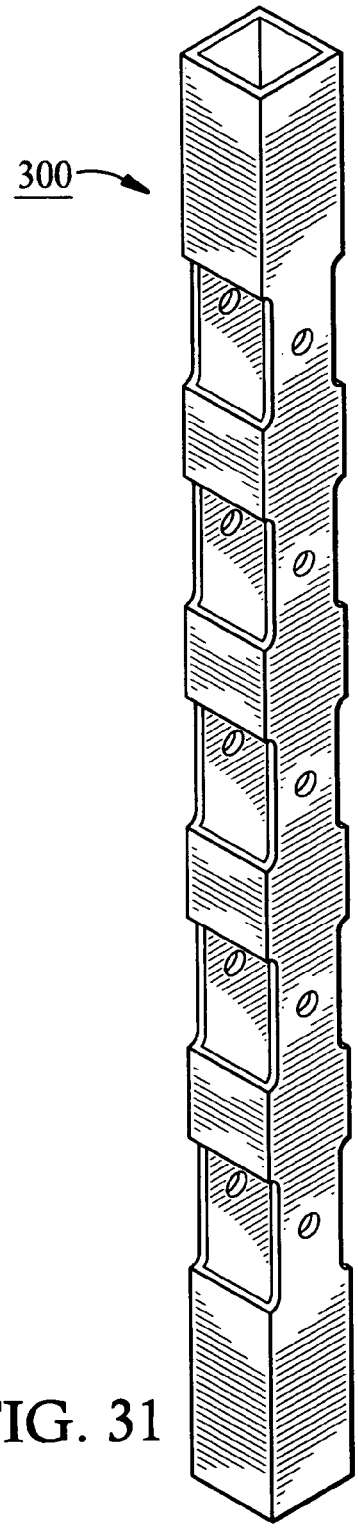
FIG. 31 is an isometric view of the baluster of FIG. 29.

FIG. 31 is an isometric view of square baluster 300 of FIGS. 29 and 30.

Figure 32:
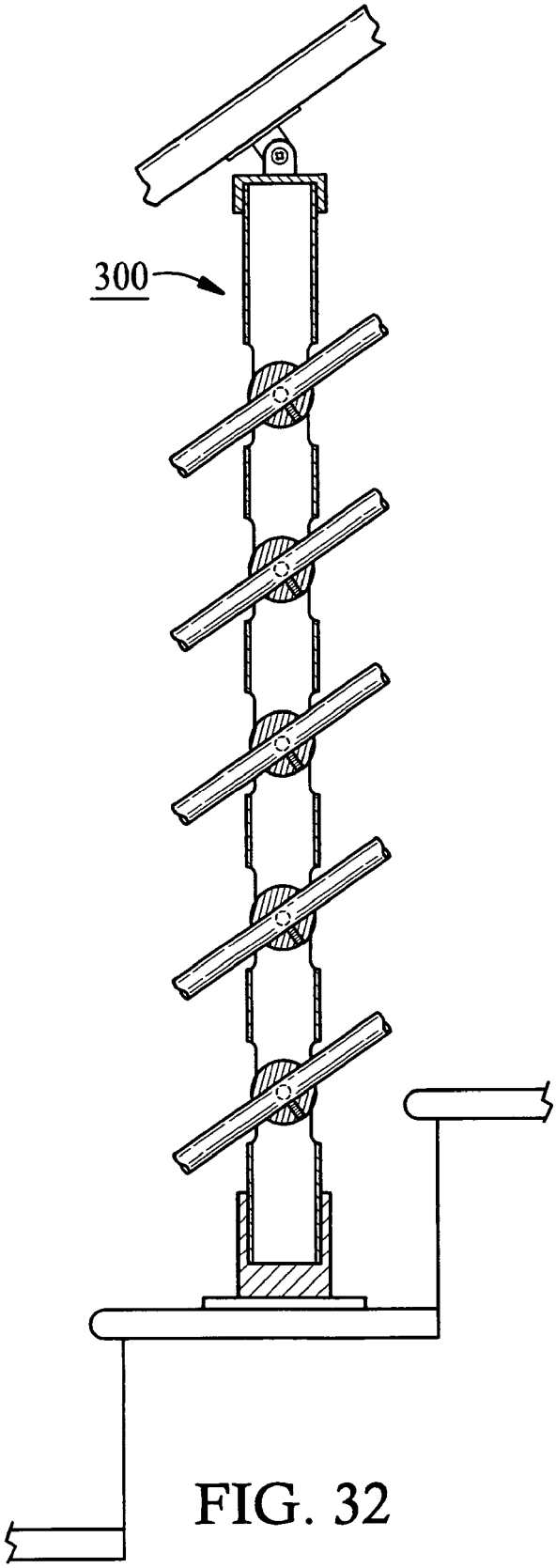
FIG. 32 is a side elevational view of the baluster of FIG. 29, installed in a stair, and with rails inserted therein.
Figure 33:
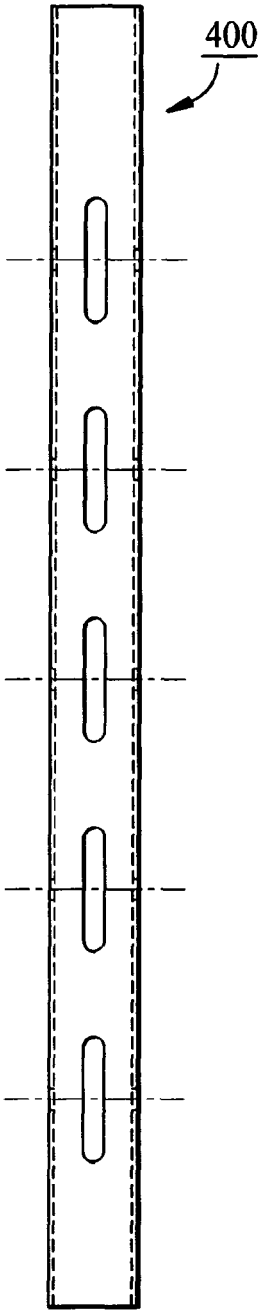
FIG. 33 is a front elevational view.
Figure 34:
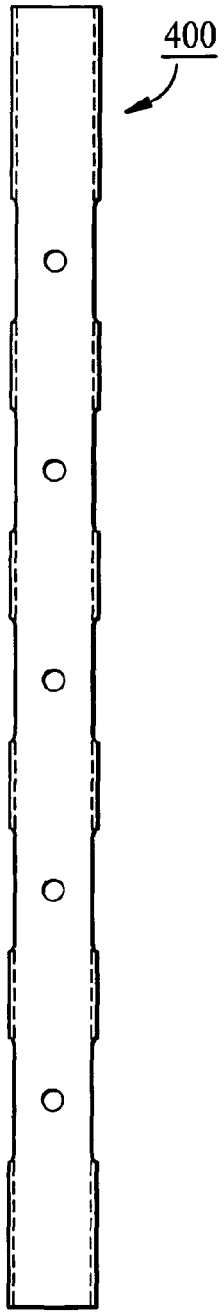
FIG. 34 is a side elevational view.
Figure 35:
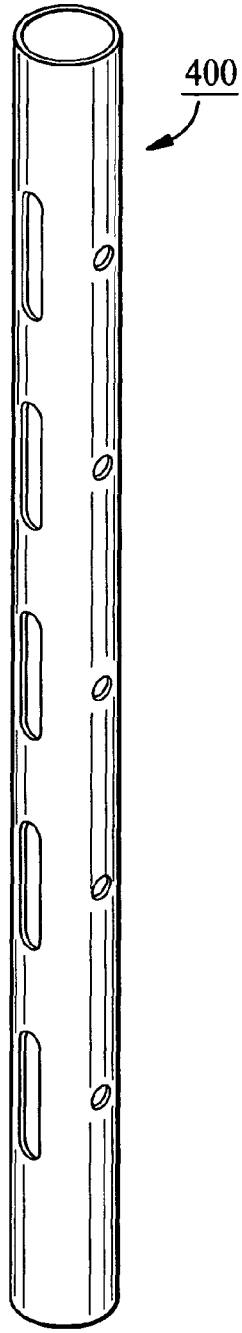
FIG. 35 is an isometric view of a round baluster for the subject invention.
Figure 37:
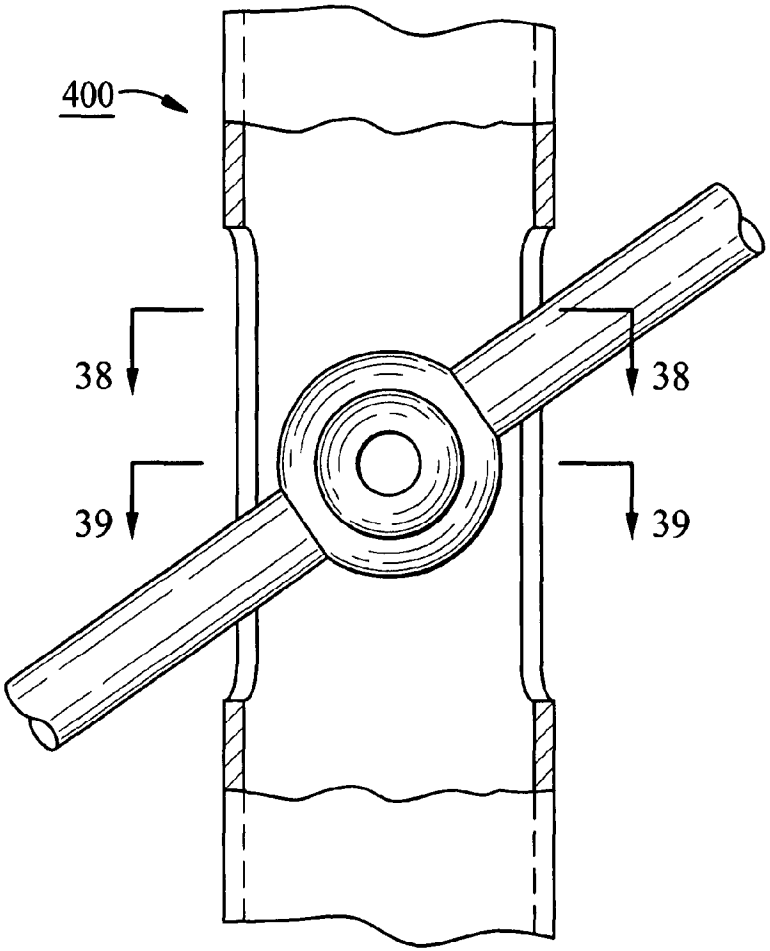
FIG. 37 is a fragmentary view of a ball nut inserted in the round baluster of FIGS. 33-35, partially in cross-section.
Figure 36:
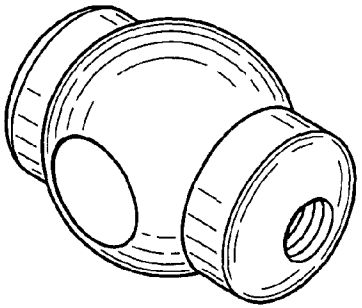
FIG. 36 is an isometric view of a ball nut for use with the round baluster of FIGS. 33-35.
Figure 38:
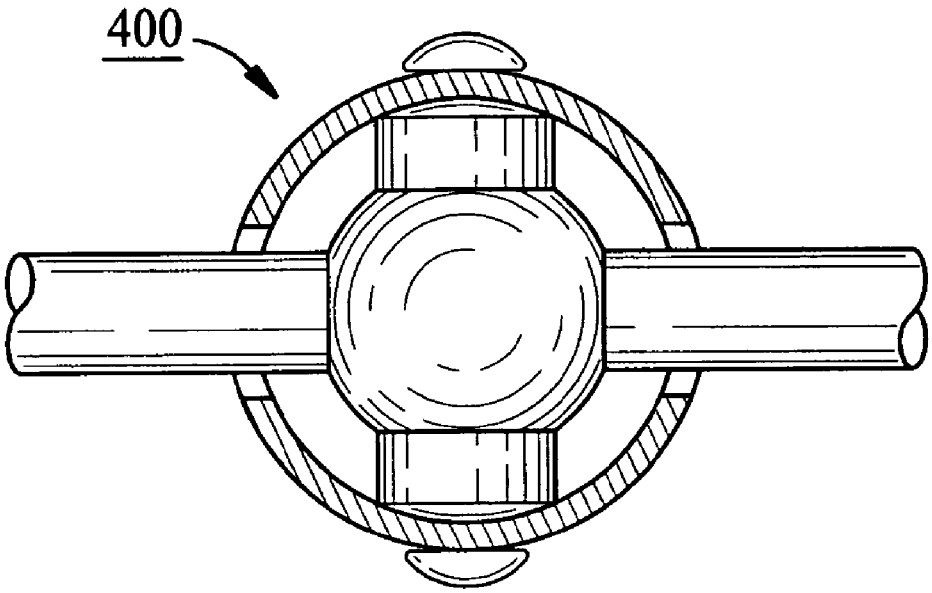
FIG. 38 is a top plan view taken along line "36-36" of FIG. 37.
Figure 39:
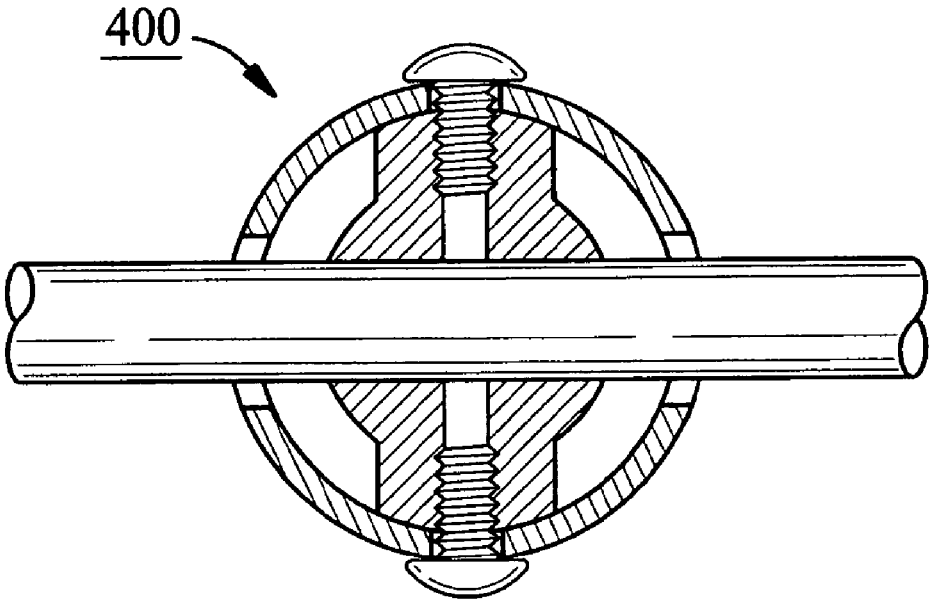
FIG. 39 is a top plan view taken along line "39-39" of FIG. 37.
Figure 40:
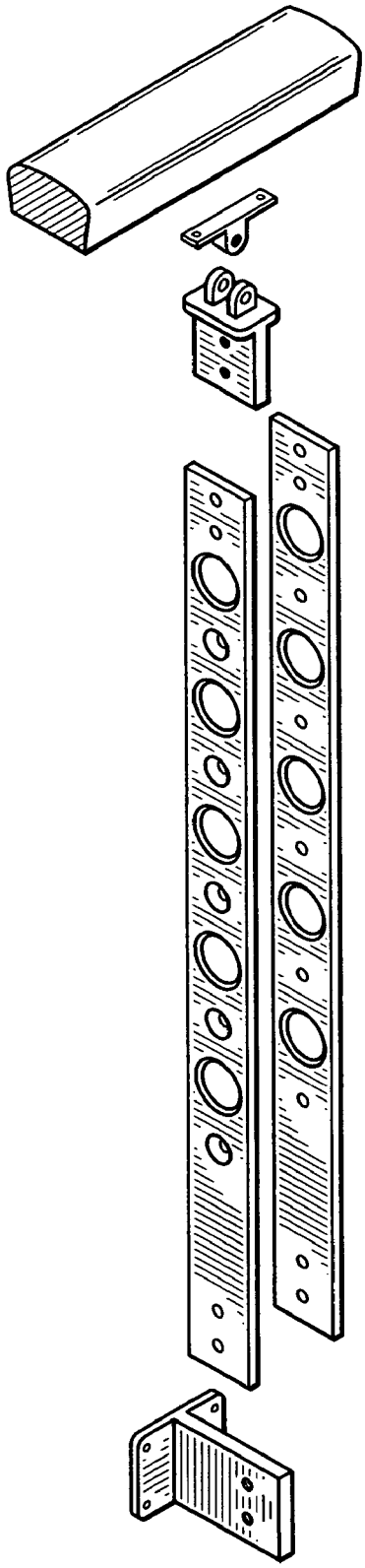
FIG. 40 is an exploded isometric view of one type of "sandwiched" type mounting brackets, with the brackets mounted for an inclined rail and for a vertical mounting surface.
Figure 41:
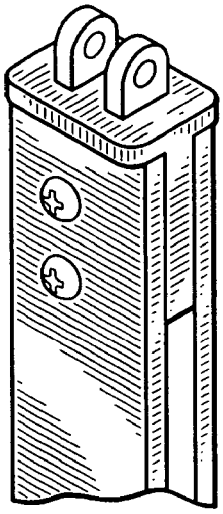
FIGS. 41 and 42 are isometric views of, respectively, top and bottom mounting brackets of the baluster of FIG. 40.
Figure 42:
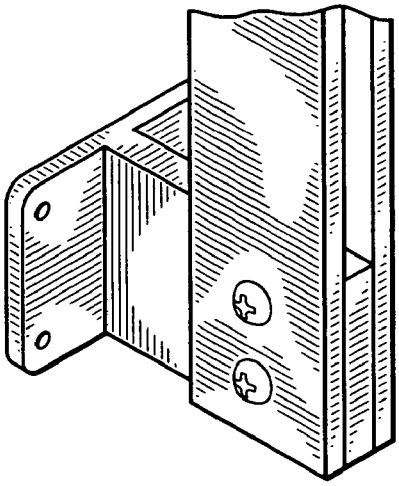
Figure 43:
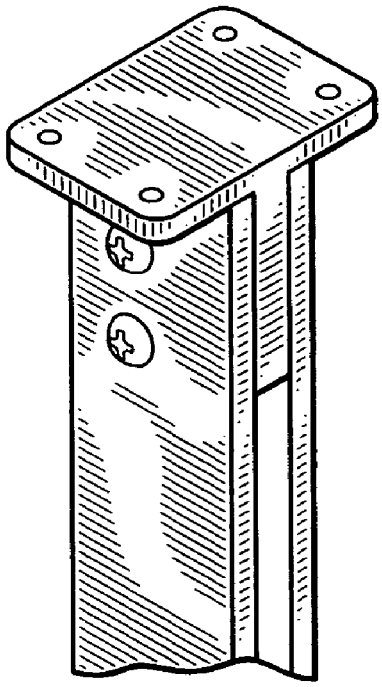
FIGS. 43-63 illustrate various means of mounting the balusters to the rails and to vertical and surface mounting surfaces.
Figure 44:
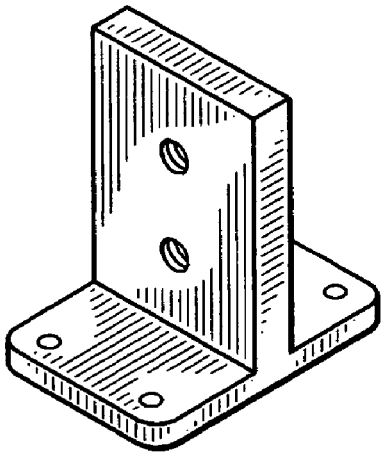
Figure 45:
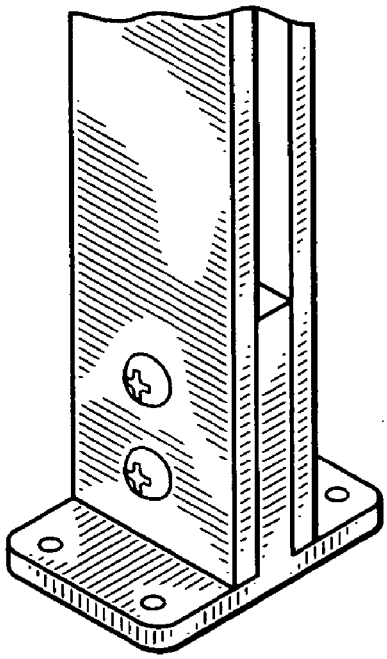
Figure 46:
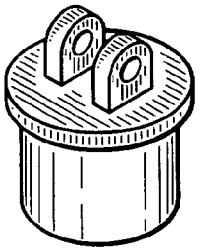
Figure 47:
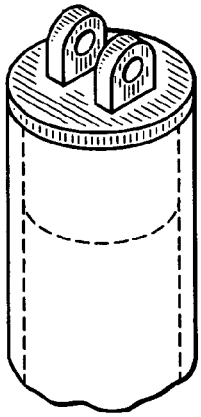
Figure 48:
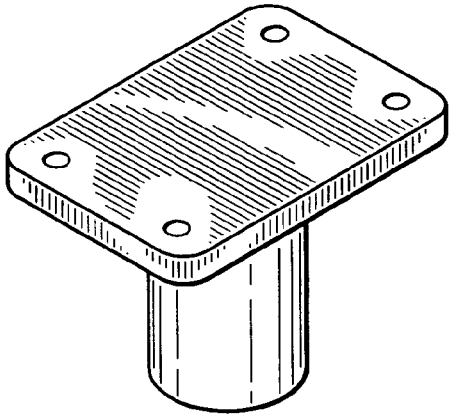
Figure 49:
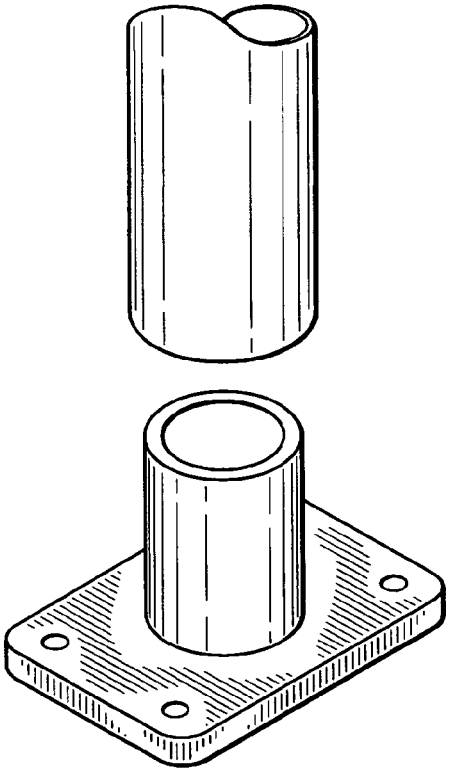
Figure 50:
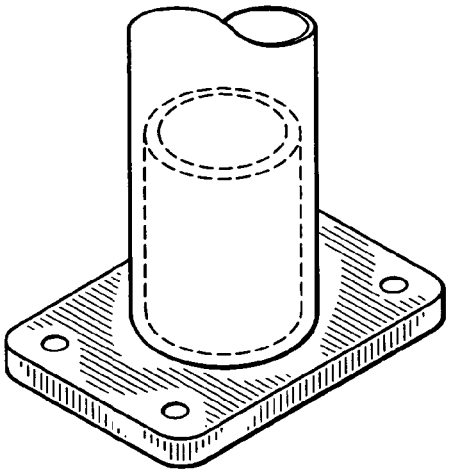
Figure 51:
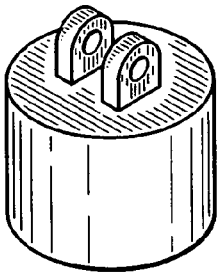
Figure 52:
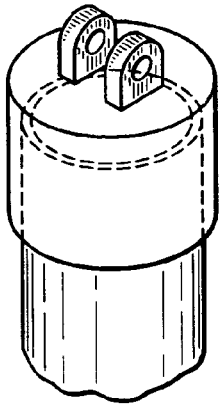
Figure 53:
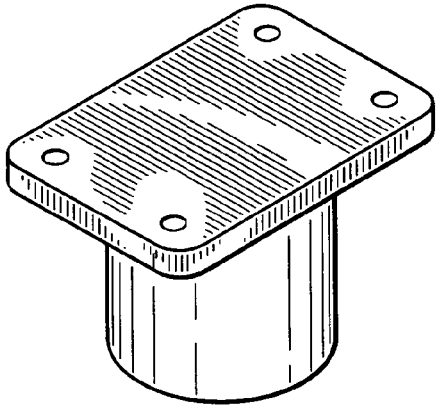
Figure 54:
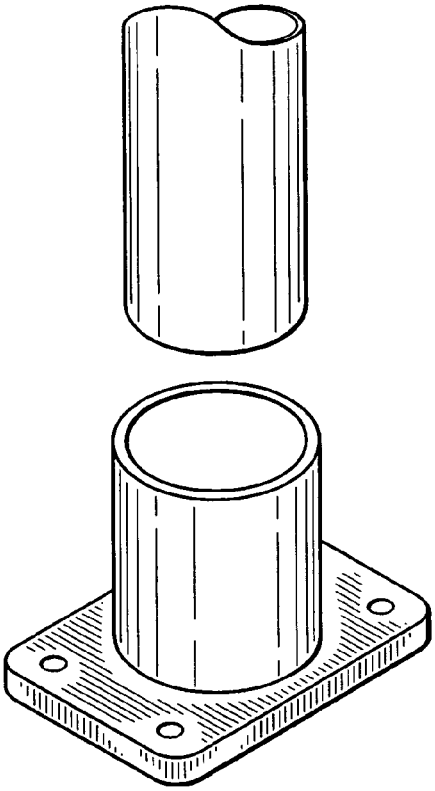
Figure 55:
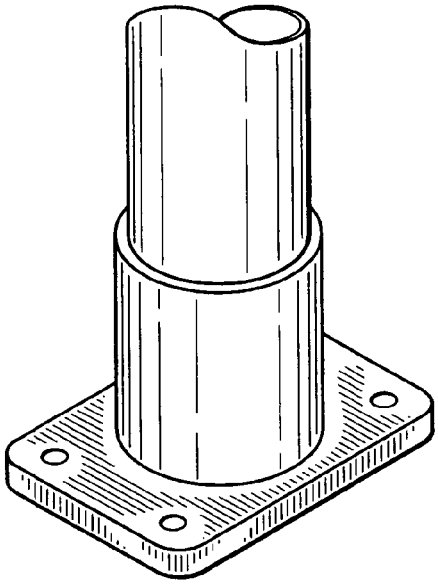
Figure 56:
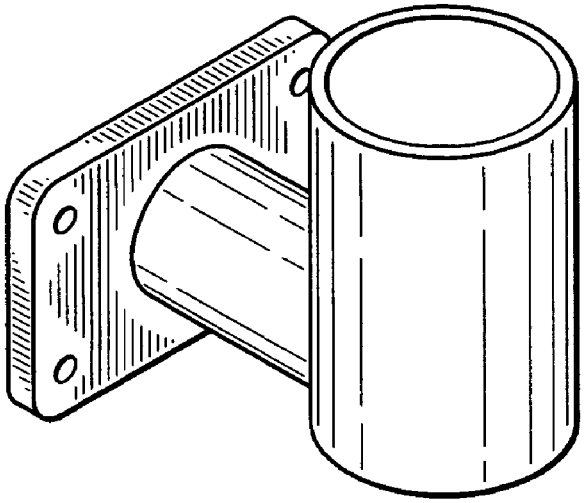
Figure 57:
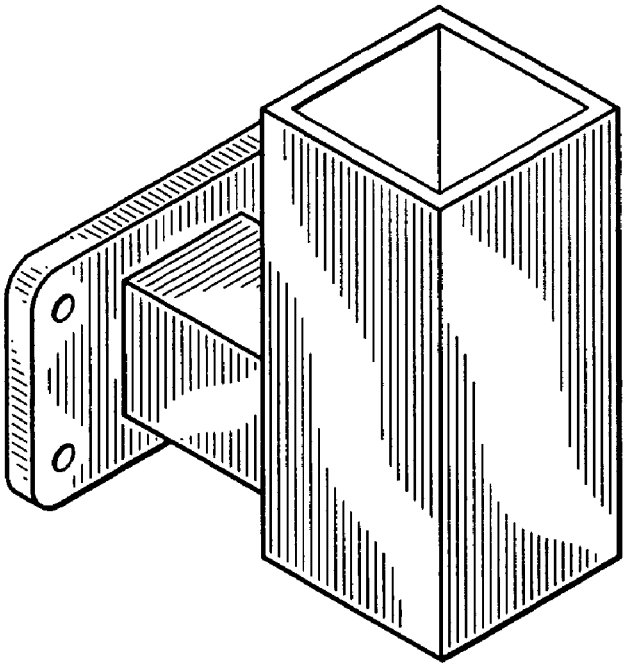
Figure 60:
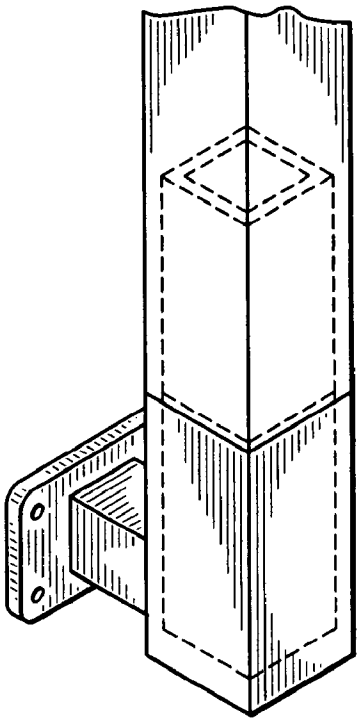
Figure 59:
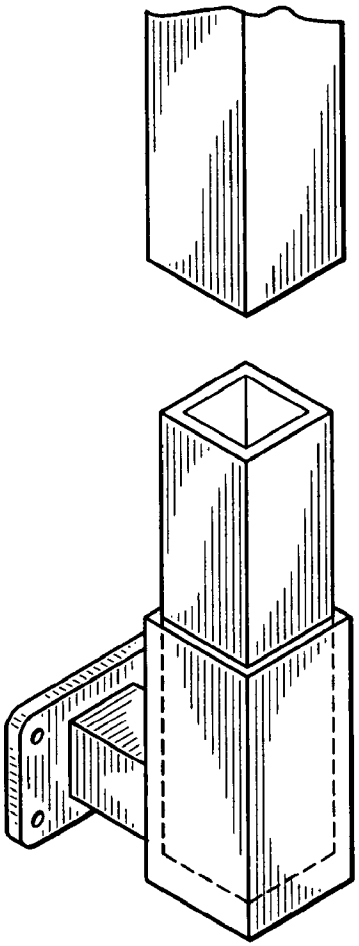
Figure 58:
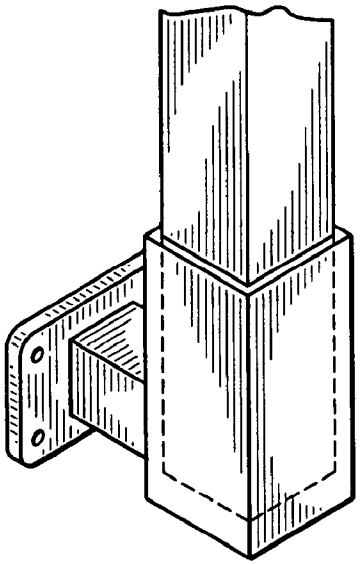
Figure 63:
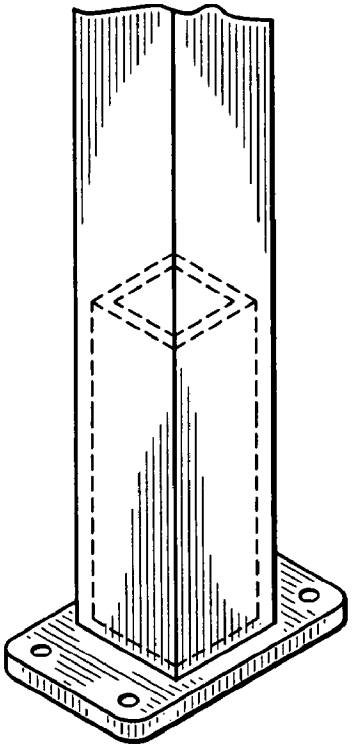
Figure 62:
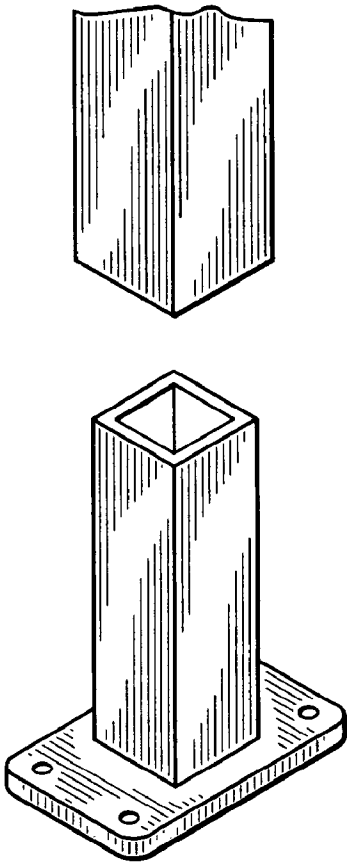
Figure 61:
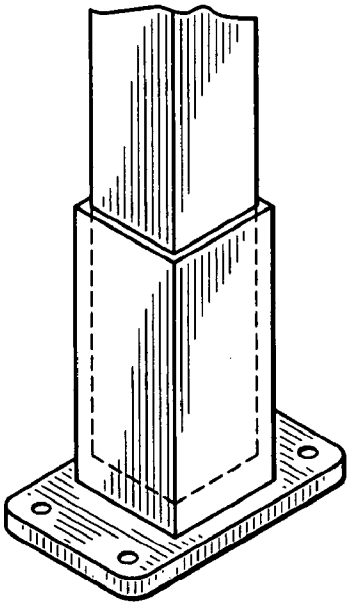

FIG. 32 illustrates square baluster 300 of FIGS. 29-31 installed with rails inserted therein.

FIGS. 33-39 indicate the baluster may be round, generally indicated by the reference numeral 400.

FIGS. 40-63 show the various forms the preceding balusters and their brackets may take.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper"; "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction and/or method without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. A railing system, comprising:

a set of vertically disposed baluster assemblies, each of the baluster assemblies comprising:

a base member having an upper surface defining a pair of opposing upper insert bores extending downwardly therein and defining a given shape;

a pair of opposing vertical plates, each of the pair of plates having:

a bottom portion with a shape substantially equal to the given shape to fit within a respective one of the upper insert bores; and a plurality of throughbores defining opposing throughbore pairs within the pair of plates when the bottom portions of the pair of plates reside in the upper insert bores ; and a number of insert members equal to the number of the pairs of the throughbores, each of the insert members:

having a member throughbore with a given cross-section; and shaped to insert between and within each of the pairs of opposing throughbores of the opposing plates such that, when the insert members are disposed between the pair of plates and the plates are inserted in the upper insert bores of the base member, each of the insert members rotatably moves therewithin; and a plurality of railing members having a cross-sectional shape corresponding to the given crosssection such that, when the base members are fixed at an installation location with each one of the base members being a distance away from at least one adjacent other one of the base members and the insert members are disposed between the pair of plates and the plates are inserted in the upper insert bores of the base members, each railing member passes, in a lonsitudinal direction of the railing member, first through an opposing throughbore of a first one of the opposing vertical plates in the pair of vertical plates, second through the member throughbore of one of the insert members, and, third, through an opposing throughbore of a second one of the opposing vertical plates in the pair of opposing vertical plates in at least two of the baluster assemblies, where the insert members pivot to align the member throughbores at an angle from horizontal that is dependent upon a vertical difference of adjacent ones of the fixed base members.

2. The railing system according to claim 1, which further comprises upper brackets each defining a pair of opposing lower insert bores extending upwardly therein and defining a given second shape, each of the pair of plates having a top portion with a shape substantially equal to the given second shape to fit within a respective one of the lower insert bores to squeeze together a respective pair of the opposing plates and, thereby, movably secure the insert members in place within respective ones of the pairs of the throughbores of the opposing plates.

3. The railing system according to claim 2, further comprising a handrail, the brackets each having a connector shaped to removably affix a portion of the handrail thereto.

4. The railing system according to claim 1, wherein the insert members are spheres.

5. The railing system according to claim 1, wherein the insert members are rotatable between 0° and at least 45° from horizontal.

6. A railing system, comprising:

a set of vertically disposed baluster assemblies, each of the baluster assemblies comprising:

a stair/railing securing bracket having a mating surface shaped to provide secure coupling to a stair;

a pair of opposing vertical plates, each of the pair of plates having:

a bottom portion coupled to the stair/railing securing bracket; and a plurality of throughbores defining opposing throughbore pairs within the pair of plates when the bottom portions of the pair of plates are coupled to the securing bracket; and a number of insert members equal to the number of opposing throughbore pairs, each of the insert members:

having a member throughbore with a given cross-section; and shaped to insert between and within each of the opposing throughbore pairs formed by the opposing plates such that each of the insert members rotatably moves therewithin; and a plurality of railing members having a cross-sectional shape corresponding to the given cross-section of the insert members such that, when the stair/railing securing brackets are fixed at an installation location with each one of the stair/railing securing brackets being a distance away from at least one adjacent other one of the stair/railing securing brackets and the insert members are disposed between the pair of plates and the plates are coupled to the stair/railing securing brackets, each railing member passes, in a longitudinal direction of the railing member, first through an opposing throughbore of a first one of the opposing vertical plates in the pair of vertical plates, second through the member throughbore of one of the insert members, and, third, through an opposing throughbore of a second one of the opposing vertical plates in the pair of opposing vertical plates in at least two of the baluster assemblies, where the insert members pivot to align the member throughbores at an angle from horizontal that is dependent upon a vertical difference of adjacent ones of the fixed base members.

7. The railing system according to claim 6, which further comprises upper brackets each coupling an upper portion of respective pairs of the opposing vertical plates at a distance from one another that squeezes together the respective pairs of the opposing plates and, thereby, movably secures the insert members in place within respective ones of the pairs of the throughbores of the opposing vertical plates.

8. The railing system according to claim 7, further comprising a handrail, the upper brackets each having a connector shaped to removably affix a portion of the handrail thereto.

9. The railing system according to claim 6, wherein the insert members are spheres.

10. The railing system according to claim 6, wherein the insert members are rotatable between 0° and at least 45° from horizontal.

* * * * *